US010359715B2

(12) United States Patent
Nakada et al.

(10) Patent No.: US 10,359,715 B2
(45) Date of Patent: Jul. 23, 2019

(54) IMAGE FORMING APPARATUS

(71) Applicant: CANON KABUSHIKI KAISHA, Tokyo (JP)

(72) Inventors: Takeharu Nakada, Saitama (JP); Tatsuya Kinukawa, Kawasaki (JP); Tomoo Akizuki, Kawasaki (JP); Masahiko Suzumi, Yokohama (JP); Ryo Morihara, Tokyo (JP); Yusuke Nakazono, Yokohama (JP); Junichi Kubota, Higashiyamato (JP); Takayuki Kanazawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/877,965

(22) Filed: Jan. 23, 2018

(65) Prior Publication Data

US 2018/0210366 A1 Jul. 26, 2018

(30) Foreign Application Priority Data

Jan. 26, 2017 (JP) ..... 2017-012504
Jan. 18, 2018 (JP) ..... 2018-006621

(51) Int. Cl.
*G03G 15/02* (2006.01)

(52) U.S. Cl.
CPC ..... *G03G 15/0275* (2013.01)

(58) Field of Classification Search
CPC ..... G03G 15/0275
See application file for complete search history.

(56) References Cited

U.S. PATENT DOCUMENTS 7,778,560 B2 8/2010 Ishibashi et al.
2004/0091277 A1* 5/2004 Miyamoto ..... G03G 15/1675 399/50

FOREIGN PATENT DOCUMENTS

JP H063970 A 1/1994
JP 2002341631 A 11/2002
JP 2008040112 A 2/2008

* cited by examiner

*Primary Examiner* — David M. Gray
*Assistant Examiner* — Michael A Harrison
(74) *Attorney, Agent, or Firm* — Rossi, Kimms & McDowell LLP

(57) ABSTRACT

An image forming apparatus including: a charging member configured to charge a photosensitive member at a charging portion by a charging voltage in which an alternate-current voltage is superimposed on a direct-current voltage; a transfer member configured to transfer a toner image formed on the photosensitive member to a recording material at a transfer portion; and a controller configured to control the charging voltage, a predetermined area of the photosensitive member passing through the transfer portion during a trailing edge of the recording material passing through the transfer portion, wherein the controller controls a value of a peak-to-peak voltage of the alternate-current voltage when the predetermined area passes through the charging portion to be larger than a value of a peak-to-peak voltage when an area that becomes the image area other than the predetermined area passes through the charging portion.

16 Claims, 12 Drawing Sheets

IMAGE FORMING APPARATUS

BACKGROUND OF THE INVENTION

Field of the Invention

The present invention relates to an image forming apparatus, such as a copying machine, a printer, or a facsimile machine, using an electrophotographic printing method.

Description of the Related Art

In an image forming apparatus of an electrophotographic printing method, an electrostatic latent image is formed by a contrast between a dark section potential (charging potential) VD, which is formed on a photosensitive member through charging by a charging member, and a bright section potential VL, which is formed on the photosensitive member through exposure of a dark section potential VD portion with light by an exposure device. Then, a developing contrast, which is a potential difference between the bright section potential VL formed on the photosensitive member and a developing bias applied to a developer carrying member, causes toner to be transferred from the developer carrying member to a bright section potential VL portion, thereby forming a toner image on the photosensitive member. The toner image formed on the photosensitive member is transferred to a transfer material, for example, a recording material (for example, paper), by a transfer bias applied to a transfer member.

In the image forming apparatus of the electrophotographic printing method, an image defect called "memory phenomenon" occurs in some cases. The memory phenomenon is a phenomenon in which charging unevenness (charging history or potential unevenness) on the photosensitive member resulting from a transferring step of transferring a toner image from the photosensitive member to the transfer material appears as density unevenness in an image. Further description regarding the memory phenomenon is made based on the following exemplary configuration. In the exemplary configuration, a charging polarity of the photosensitive member is a negative polarity, and toner having been charged to the same polarity as the charging polarity of the photosensitive member adheres to the bright section potential VL portion in which an absolute value of the dark section potential VD of the negative polarity is reduced, thereby forming a toner image on the photosensitive member. Then, the toner image is directly transferred to the recording material.

With such a configuration, for example, when the recording material is separated from the photosensitive member after the transfer, separation electric discharge may occur between a trailing edge of the recording material in a conveyance direction thereof and the photosensitive member, with the result that positive charges are liable to move onto the photosensitive member. When the amount of positive charges having moved onto the photosensitive member is relatively small, the positive charges are removed, at the time of charging the photosensitive member, by a charging portion located on a downstream side in a rotation direction of the photosensitive member with respect to a transfer portion. However, when the amount of positive charges having moved onto the photosensitive member exceeds a certain amount, the positive charges cannot be removed by the charging portion, with the result that an absolute value of the dark section potential VD becomes smaller in an area on the photosensitive member in which the separation electric discharge has occurred. As a result, the developing contrast in that area becomes larger than that in other areas. Thus, the amount of toner which adheres during the developing increases, and the density of the image becomes higher. As described above, the partial charging unevenness on the photosensitive member resulting from the transferring step may cause occurrence of the memory phenomenon involving a lateral black streak (portion with higher density extending along a rotation axis direction of the photosensitive member) in an image to be formed later.

In order to suppress the memory phenomenon, there has been proposed a configuration in which a separation electric discharge prevention electrode, which extends in the rotation axis direction of the photosensitive member, is provided in the vicinity of a position of separation between the photosensitive member and the recording material, and in which a voltage having a polarity opposite to that of the transfer bias is applied to the separation electric discharge prevention electrode (Japanese Patent Application Laid-Open No. H06-3970).

However, the related-art configuration described above requires addition of a space for installing the separation electric discharge prevention electrode and a drive circuit for generating a voltage having a polarity opposite to that of the transfer bias, which may result in an increase in cost. Further, the memory phenomenon caused by the charging unevenness on the photosensitive member resulting from the transferring step occurs not only by occurrence of the separation electric discharge between the trailing edge of the recording material in the conveyance direction and the photosensitive member, but also by entry of a leading edge of the recording material in the conveyance direction to the transfer portion or by the influence of the toner image which passes through the transfer portion. With the configuration in which the separation electric discharge prevention electrode is provided in the vicinity of the position of separation between the photosensitive member and the recording material, there is difficulty in suppressing the memory phenomenon that occurs in those cases. Therefore, there have been demands for a method of suppressing occurrence of the memory phenomenon by approaches different from that of the related-art method described above.

SUMMARY OF THE INVENTION

The present invention provides an image forming apparatus configured to suppress an image defect caused by charging unevenness on a photosensitive member resulting from a transferring step.

According to one embodiment of the present invention, there is provided an image forming apparatus, comprising:

a photosensitive member, which is rotatable;

a charging member configured to charge the photosensitive member at a charging portion;

an applying device configured to apply a charging voltage to the charging member, the charging voltage being obtained by superimposing an alternate-current voltage on a direct-current voltage;

an exposure device configured to expose the charged photosensitive member with light to form an electrostatic image on an image area on the photosensitive member; a developing device configured to supply toner to the electrostatic image on the photosensitive member to form a toner image;

a transfer member to which a voltage is applied to transfer the toner image on the photosensitive member to a recording material at a transfer portion; and a controller configured to control the charging voltage, wherein a predetermined area of the photosensitive member passes through the transfer portion during a trailing edge of the recording material in a conveyance direction of the recording material passing through the transfer portion, and wherein the controller controls a value of a peak-to-peak voltage of the alternate-current voltage of the charging voltage that is applied to the charging member when the predetermined area passes through the charging portion to be larger than a value of a peak-to-peak voltage of the alternate-current voltage when an area that becomes the image area other than the predetermined area passes through the charging portion.

Further features of the present invention will become apparent from the following description of exemplary embodiments with reference to the attached drawings.

DESCRIPTION OF THE EMBODIMENTS

Now, detailed description is made of an image forming apparatus according to embodiments of the present invention with reference to the drawings.

Embodiment 1

1. Image Forming Apparatus

<Overall Configuration and Operation of Image Forming Apparatus>

Figure 1:
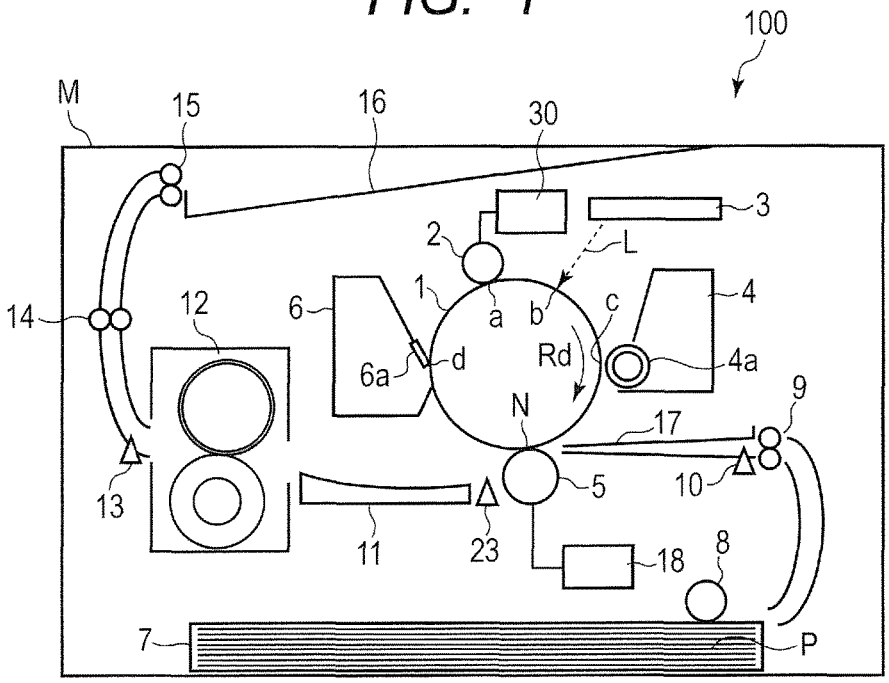
FIG. 1 is a schematic sectional view of an image forming apparatus according to Embodiment 1 of the present invention.

FIG. 1 is a schematic sectional view of an image forming apparatus 100 according to Embodiment 1 of the present invention. The image forming apparatus 100 of Embodiment 1 is a laser printer of an electrophotographic printing method.

A photosensitive drum 1 being a photosensitive member (electrophotographic photosensitive member) of a drum type (cylindrical shape), which is rotatable and serves as an image bearing member, is driven to rotate by a drive source (not shown) in a direction (clockwise direction) indicated by an arrow Rd in FIG. 1. A surface of the photosensitive drum 1 being rotated is uniformly charged to a predetermined potential having a predetermined polarity (negative polarity in Embodiment 1) by a charging roller 2 being a roller-shaped charging member. In a charging step, a predetermined charging bias (charging voltage) is applied to the charging roller 2 by a charging power supply (high-voltage power supply circuit) 30 serving as an applying unit (applying device). In Embodiment 1, an oscillation voltage, which is obtained through superimposition of a direct-current voltage (DC voltage or direct-current component) and an alternate-current voltage (AC voltage or alternate-current component), is applied as a charging bias to the charging roller 2.

The charged surface of the photosensitive drum 1 is scanned and exposed with laser light L in accordance with image information by an exposure device (laser optical system or laser scanner device) 3, and thus an electrostatic latent image (electrostatic image) is formed on the photosensitive drum 1. The electrostatic latent image formed on the photosensitive drum 1 is developed (formed into a visible image) with use of toner serving as developer by a developing device 4 serving as a developing unit, and thus a toner image is formed on the photosensitive drum 1. The developing device 4 includes a developing roller 4*a* serving as a developer carrying member configured to carry and convey toner. In a developing step, a predetermined developing bias (developing voltage) is applied to the developing roller 4*a* by a developing power supply (high-voltage power supply circuit), which is not shown. In Embodiment 1, the developing device 4 uses one-component developer as developer to cause toner to fly from the developing roller 4*a*, which is arranged closely opposed to the photosensitive drum 1, to the photosensitive drum 1 (one-component toner projection development (jumping developing method)). Further, in Embodiment 1, toner that is charged to the same polarity as the charging polarity of the photosensitive drum 1 adheres to an exposure portion on the photosensitive drum 1 in which at least part of the charges has been removed (absolute value of the potential is reduced) through exposure with light after being uniformly charged. In Embodiment 1, the original charging polarity of toner at the time of developing is the negative polarity.

The toner image formed on the photosensitive drum 1 is transferred onto a recording material (transfer material or sheet) P, for example, paper, by an action of a transfer roller 5 being a roller-shaped transfer member. The transfer roller 5 is urged (pressed) toward the photosensitive drum 1 by a pressure spring (not shown) being an urging member, thereby forming a transfer portion (transfer nip) N being a contact portion between the photosensitive drum 1 and the transfer roller 5. The transfer roller 5 is driven to rotate with the rotation of the photosensitive drum 1. In Embodiment 1, the transfer roller 5 has a configuration in which a conductive elastic layer is provided around a core metal (core material) made of a metal, and has an outer diameter of 12.5 mm. The transfer roller 5 is an example of a transfer member which is arranged so as to be directly opposed to the photosensitive drum 1 when the recording material P being a transfer material is not present at the transfer portion N. The toner image formed on the photosensitive drum 1 is transferred by an electrostatic force and pressure onto the recording material P that is conveyed while being nipped between the transfer roller 5 and photosensitive drum 1. In a transferring step, a transfer bias (transfer voltage) being a direct-current voltage having a polarity opposite to the original charging polarity of toner is applied to the transfer roller 5 by a transfer power supply (high-voltage power supply circuit) 18. The recording material P is stored in a recording material cassette 7. The recording material P is fed one by one by a feed roller 8, conveyed by conveyance rollers 9, and fed to the transfer portion N along a pre-transfer guide 17 being a guide member.

The recording material P having the toner image transferred thereon is conveyed to a fixing device 12 serving as a fixing unit along a post-transfer guide 11 after having been reduced in surface charge amount by a charge eliminating member 23. In Embodiment 1, the charge eliminating member 23 is formed of a conductive member which is electrically grounded (connected to the ground). The charge eliminating member 23 is brought into contact with a surface of the recording material P on a side opposite to the surface having the toner transferred thereon, thereby removing at least part of the charges on the recording material P. The recording material P having been conveyed to the fixing device 12 is heated and pressurized in the fixing device 12 so that the toner image is fixed to the recording material P. After that, the recording material P is conveyed by conveyance rollers 14 and delivery rollers 15, and delivered onto a delivery tray 16 formed on an upper surface of an apparatus main body M of the image forming apparatus 100 in FIG. 1.

Further, toner (transfer residual toner) that remains on the surface of the photosensitive drum 1 after the transferring step is removed from the photosensitive drum 1 and collected by a cleaning device 6. The cleaning device 6 uses a cleaning blade 6*a* serving as a cleaning member to scrape off the transfer residual toner from the surface of the photosensitive drum 1 being rotated and collect the transfer residual toner.

During continuous image formation of continuously forming and outputting images on a plurality of recording materials P, the image forming apparatus 100 of Embodiment 1 is capable of outputting the images with a throughput (print speed) of 40 sheets per minute. An area on the photosensitive drum 1 in which a toner image to be transferred to each recording material P may be formed is referred to as an image area on the photosensitive drum 1. The image area on the photosensitive drum 1 has predetermined lengths in the rotation direction and the rotation axis direction of the photosensitive drum 1 in accordance with a size of the recording material P. The lengths of the image area on the photosensitive drum 1 in the rotation direction and the rotation axis direction of the photosensitive drum 1 may be smaller than, larger than, or substantially equal to the size of the recording material P, but are typically smaller. Further, an area on the photosensitive drum 1 in which the toner image is not formed in accordance with the size of the recording material P is referred to as a non-image area on the photosensitive drum 1.

A position in the rotation direction of the photosensitive drum 1 at which the charging by the charging roller 2 is performed is a charging portion (charging position) "a". In Embodiment 1, the charging roller 2 charges the photosensitive drum 1 by electric discharge that occurs in at least one of small gaps between the charging roller 2 and the photosensitive drum 1 that are formed on an upstream side and a downstream side of the contact portion between the charging roller 2 and the photosensitive drum 1 in the rotation direction of the photosensitive drum 1. However, for easy understanding, the contact portion between the charging roller 2 and the photosensitive drum 1 may be regarded as the charging portion "a". Further, a position in the rotation direction of the photosensitive drum 1 at which the exposure by the exposure device 3 is performed is an exposure portion (exposure position) "b". A position in the rotation direction of the photosensitive drum 1 at which toner is fed from the developing roller 4*a* to the photosensitive drum 1 (opposed portion of the developing roller 4*a* and the photosensitive drum 1 in Embodiment 1) is a developing portion (developing position) "c". A position in the rotation direction of the photosensitive drum 1 at which a toner image is transferred from the photosensitive drum 1 to the recording material P (contact portion between the transfer roller 5 and the photosensitive drum 1 in Embodiment 1) is the transfer portion N. An abutment portion of the cleaning blade 6*a* and the photosensitive drum 1 in the rotation direction of the photosensitive drum 1 is a cleaning portion (cleaning position) "d".

<Charging Roller>

In Embodiment 1, the charging roller 2 has a configuration in which an outer periphery of the core metal (core material) made of a material, for example, iron or stainless steel (SUS), is covered with a conductive elastic layer made of a material, for example, Hydrin rubber, and in which a protective layer made of a material, for example, urethane rubber, is provided as a surface layer. The charging roller 2 is arranged in contact with the surface of the photosensitive drum 1, and is driven to rotate with the rotation of the photosensitive drum 1.

Figure 2:
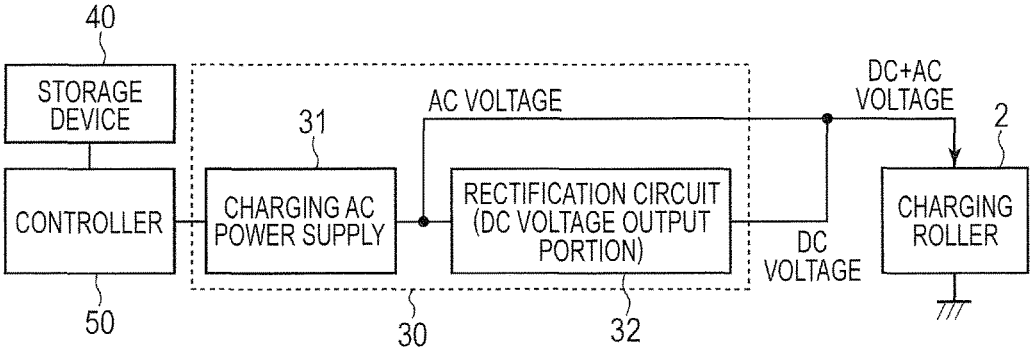
FIG. 2 is a functional block diagram for illustrating a mode of controlling a charging bias in Embodiment 1.

FIG. 2 is a schematic functional block diagram for illustrating a mode of controlling a charging bias in Embodiment 1. In Embodiment 1, operations of components of the image forming apparatus 100 are controlled by a controller (control circuit) 50 provided to the apparatus main body M. The controller 50 controls the operations of the components in accordance with a program stored in a storage device 40 provided to the apparatus main body M and based on signals from various sensors provided to the apparatus main body M. The storage device 40 is formed of a ROM or a RAM. The controller 50 reads charge setting values (for example, DC voltage and peak-to-peak voltage of AC voltage) stored in the storage device 40 from the storage device 40, and outputs a drive signal to be input to the charging power supply 30.

In Embodiment 1, the charging power supply 30 includes a charging AC power supply (alternate-current voltage output portion) 31 and a rectification circuit (direct-current voltage output portion) 32. The rectification circuit 32 generates, based on the drive signal from the controller 50, a DC voltage from an AC voltage given by the charging AC power supply 31. Then, the charging power supply 30 outputs a charging bias (DC+AC voltage), which is obtained through superimposition of the AC voltage given by the charging AC power supply 31 to the DC voltage generated by the rectification circuit 32, and applies the charging bias to the charging roller 2.

Through use of the DC+AC voltage as the charging bias, the surface of the photosensitive drum 1 can be more stably and uniformly charged as compared to a case in which only the DC voltage is used. Specifically, for example, through application of a charging bias, which is obtained through superimposition of an AC voltage having a peak-to-peak voltage Vpp of 1,300 V to a DC voltage of −400 V, to the charging roller 2, the surface of the photosensitive drum 1 can be substantially uniformly charged to −400 V. That is, in general, when a potential difference between the charging roller 2 and the photosensitive drum 1 exceeds a certain magnitude, electric discharge occurs between the charging roller 2 and the photosensitive drum 1. When the DC+AC voltage is used, the potential difference between the charging roller 2 and the photosensitive drum 1, which is a condition of occurrence of the electric discharge, is determined in accordance with an amplitude of the voltage applied to the charging roller 2. When the amplitude of the voltage applied to the charging roller 2 (changed amount from a value of the DC voltage) exceeds an electric discharge start voltage Vth, the electric discharge occurs. That is, in a case where the peak-to-peak voltage Vpp of the AC voltage applied to the charging roller 2 exceeds twice the electric discharge start voltage Vth, when the AC voltage applied to the charging roller 2 takes a peak (maximum value or minimum value), the electric discharge occurs between the charging roller 2 and the photosensitive drum 1. Then, a dark section potential (charging potential) VD of the photosensitive drum 1 is determined by the DC voltage applied to the charging roller 2 (average value of the voltage applied to the charging roller 2).

<Photosensitive Drum>

In general, the photosensitive drum 1 has a configuration in which a photosensitive material, for example, organic photoconductor (OPC), amorphous selenium, or amorphous silicon, is provided on a drum-shaped (cylinder-shaped) base (conductive base) made of a material, for example, aluminum or nickel.

In Embodiment 1, the photosensitive drum 1 is an OPC photosensitive member having an outer diameter of 24 mm and a negative chargeability. The photosensitive drum 1 has a configuration in which a photosensitive layer is provided on a surface of the conductive base formed of a cylinder made of aluminum. In the photosensitive layer, a charge generating layer and a charge transporting layer are layered in the stated order from the conductive base side. In Embodiment 1, the photosensitive drum 1 is driven to rotate at a peripheral speed (process speed) of 220 mm/sec. In Embodiment 1, the dark section potential VD on the photosensitive drum 1, which is formed through the charging by the charging roller 2, is −400 V. Further, in Embodiment 1, the bright section potential VL on the photosensitive drum 1, which is formed through exposure by the exposure device 3, is −100 V. When toner is transferred from the developing roller 4*a* to the bright section potential VL portion, an electrostatic latent image is developed into a toner image.

When the charge transporting layer provided on the conductive base is abraded, problems such as a charge defect may occur in the photosensitive drum 1. The abraded amount of the photosensitive drum 1 through the use tends to become larger as the electric discharge amount at the time of charging becomes larger. Therefore, there is a tendency that the abraded amount becomes larger as the peak-to-peak voltage Vpp of the AC voltage of the charging bias becomes larger.

<Recording Material Conveyance Path>

In Embodiment 1, there are arranged the recording material cassette 7, the feed roller 8, the conveyance rollers 9, a top sensor 10, the pre-transfer guide 17, the post-transfer guide 11, a delivery sensor 13, the conveyance rollers 14, the delivery rollers 15, and the delivery tray 16 in the stated order along a conveyance path of the recording material P.

The top sensor 10 detects a leading edge and a trailing edge of the recording material P in the conveyance direction, and outputs a detection signal to be input to the controller 50. The leading edge and the trailing edge of the recording material P in the conveyance direction are also simply referred to as a leading edge and a trailing edge of the recording material P. The output of the top sensor 10 is turned on when the recording material P is present at a detection portion at which the top sensor 10 detects the recording material P. The output of the top sensor 10 is turned off when the recording material P is not present at the detection portion. The controller 50 is capable of detecting timings when the leading edge and the trailing edge of the recording material P pass through the top sensor 10 based on the output of the top sensor 10. The controller 50 detects positions of the leading edge and the trailing edge of the recording material P based on the ON/OFF timings of the output of the top sensor 10, and controls, for example, formation of the electrostatic latent image, ON/OFF timings of the transfer bias, and changes in output, in synchronization with the movement of the recording material P.

Further, the process speed (conveyance speed of the recording material P or peripheral speed of the photosensitive drum 1) is set in advance to a predetermined value. Therefore, the controller 50 is capable of detecting, through calculation based on the ON/OFF timings of the output of the top sensor 10, a position on the photosensitive drum 1 which passes through the transfer portion N when a freely-selected position of the recording material P in the conveyance direction passes through the transfer portion N.

For the purpose of checking occurrence of a jam of the recording material P (paper jam), the delivery sensor 13 detects the trailing edge of the recording material P, and outputs a detection signal to be input to the controller 50.

2. Control of Charging Bias

In Embodiment 1, at the time of image formation, the controller 50 determines a predetermined area on the photosensitive drum 1 that passes through the transfer portion N at a predetermined timing, in which the above-mentioned memory phenomenon may occur. Then, in a case where an image area on the photosensitive drum 1 is passing through the charging portion "a" when the predetermined area passes through the charging portion "a", the controller 50 performs the following control. That is, a value of the peak-to-peak voltage Vpp of the AC voltage of the charging bias that is used when the predetermined area passes through the charging portion "a" is set larger than a value of the peak-to-peak voltage Vpp of the AC voltage of the charging bias that is used when an area that forms an image area other than the predetermined area passes through the charging portion "a".

In the image forming apparatus 100 of Embodiment 1, due to the separation electric discharge which occurs when the trailing edge of the recording material P separates from the photosensitive drum 1 after the transfer, the above-mentioned memory phenomenon involving a lateral black streak is liable to occur. Therefore, in Embodiment 1, the above-mentioned predetermined area is set to an area including a position on the photosensitive drum 1 that passes through the transfer portion N when the trailing edge of the recording material P passes through the transfer portion N. That is, the predetermined area of the photosensitive member 1 passes through the transfer portion N during the trailing edge of the recording material P in the conveyance direction of the recording material P passing through the transfer portion N. In Embodiment 1, the controller 50 detects, through calculation based on the ON/OFF timings of the output of the top sensor 10, the predetermined area including the position on the photosensitive drum 1 that passes through the transfer portion N when the trailing edge of the recording material P passes through the transfer portion N.

In Embodiment 1, the position on the photosensitive drum 1 that passes through the transfer portion N when the trailing edge of the recording material P passes through the transfer portion N is, more specifically, a position on the photosensitive drum 1 with which the trailing edge of the recording material P is brought into contact at the transfer portion N. Herein, for easy understanding, the position on the photosensitive drum 1 that passes through the transfer portion N when the trailing edge of the recording material P passes through the transfer portion N is also referred to as "position on the photosensitive drum 1 corresponding to the trailing edge of the recording material P".

Figure 3A:
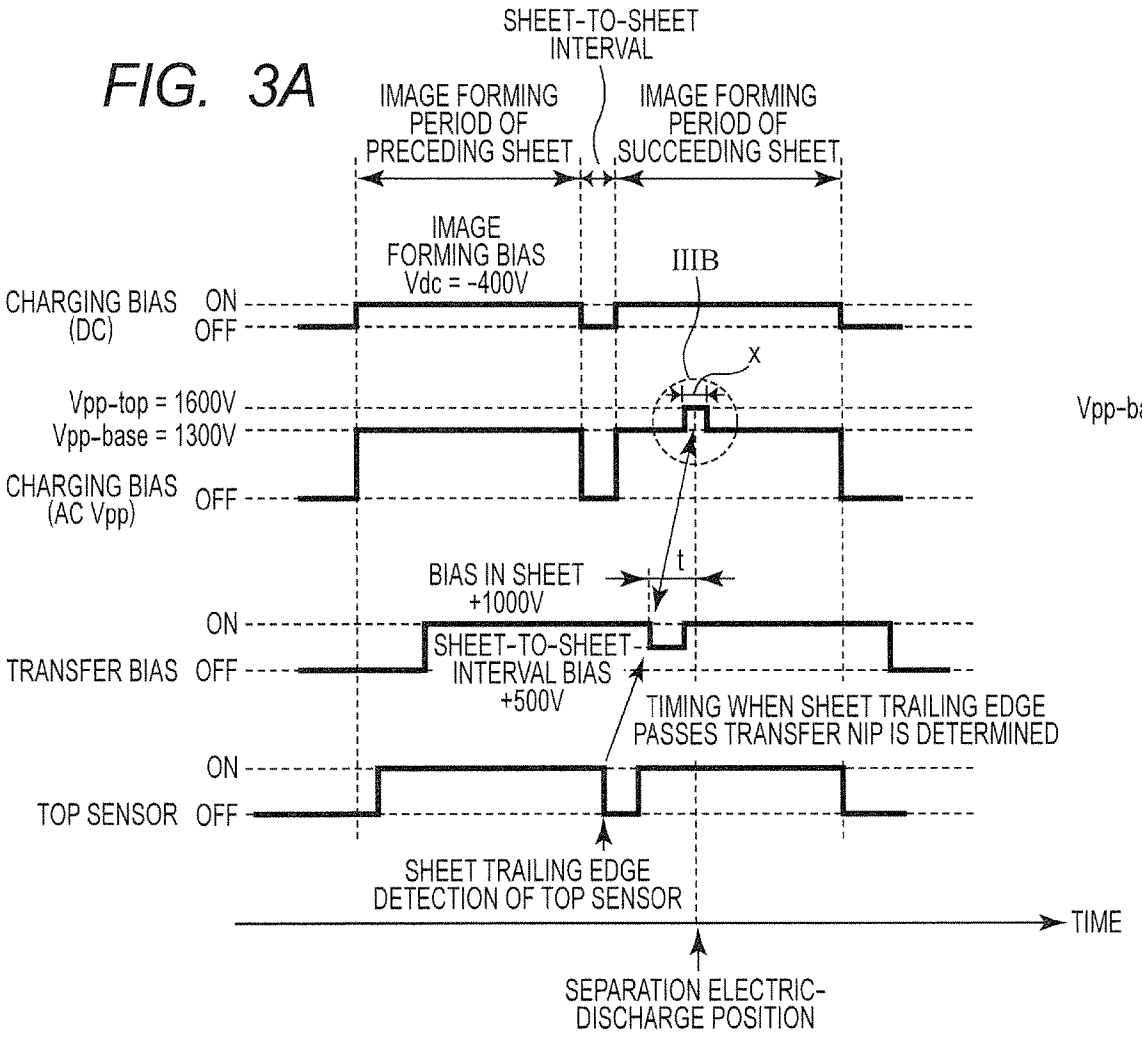
FIG. 3A is a sequence chart of charging bias control in Embodiment 1.
Figure 3B:
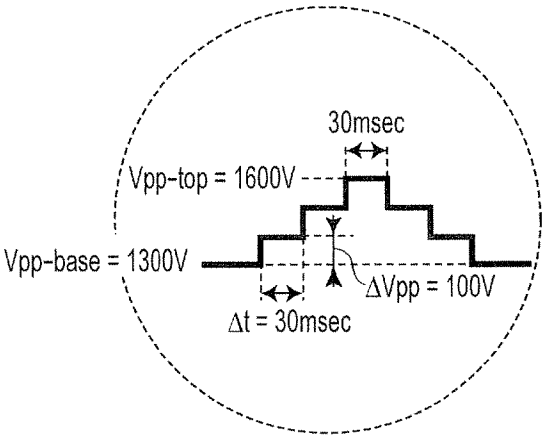
FIG. 3B is an enlarged view of the encircled portion IIIB in FIG. 3A.

FIG. 3A is a sequence chart for illustrating switching timings of the charging bias and the transfer bias and ON/OFF timings of the output of the top sensor 10 in a case where printing is continuously performed on two recording materials (here, recording sheets) P in Embodiment 1. FIG. 3B is an enlarged view of the encircled portion IIIB in FIG. 3A. FIG. 3A is a sequence chart for illustrating a case in which an image area for a toner image to be transferred onto a succeeding recording material P is passing through the charging portion "a" when a predetermined area X including a position on the photosensitive drum 1 corresponding to the trailing edge of the preceding recording material P first passes through the charging portion "a". That is, FIG. 3A is a sequence chart for illustrating a case in which a conveyance interval (that is, sheet-to-sheet interval) of the recording materials P at the time of the continuous image formation is less than one rotation of the photosensitive drum 1.

The symbol "t" illustrated in FIG. 3A represents a time period from when the position on the photosensitive drum 1 corresponding to the trailing edge of the recording material P has passed through the transfer portion N when the position on the photosensitive drum 1 corresponding to the trailing edge of the recording material P arrives at the charging portion "a". Further, the arrows which are illustrated so as to bridge the charts of the top sensor, the transfer bias, and the charging bias in FIG. 3A represent that timings are synchronized at both ends of each arrow. Further, the "image forming period" in FIG. 3A represents a period corresponding to an image area on the photosensitive drum 1. Further, although not illustrated in FIG. 3A, with regard to surface potentials of the image area on the photosensitive drum 1, before passage through the transfer portion N, the dark section potential VD is set to −400 V, and the bright section potential VL is set to −100 V. In the following, the DC voltage of the charging bias is also simply referred to as "DC voltage", and the AC voltage of the charging bias is also simply referred to as "AC voltage".

First, the charging bias is described. At substantially the same timing as a timing at which an image area for a toner image to be transferred onto the preceding recording material P arrives at the charging portion "a", application of the charging bias is started. At this time, the DC voltage is set to Vdc=−400 V, and the peak-to-peak voltage Vpp of the AC voltage is set to Vpp-base=1,300 V, where "Vpp-base" corresponds to a reference value of the peak-to-peak voltage Vpp of the AC voltage that is used when an area other than the predetermined area X in the image area passes through the charging portion "a". At this time, a charging bias of −400±(1,300/2) V is applied to the charging roller 2.

At substantially the same timing as a timing at which the image area for the toner image to be transferred onto the preceding recording material P has passed through the charging portion "a", application of the charging bias is stopped. Then, at substantially the same timing as a timing at which an image area on the photosensitive drum 1 for a toner image to be transferred onto the succeeding recording material P arrives at the charging portion "a", application of the charging bias is restarted. The DC voltage and the AC voltage of the charging bias at this time are the same as those described above.

After that, in synchronization with the timing at which the predetermined area X including the position on the photosensitive drum 1 corresponding to the trailing edge of the preceding recording material P passes through the charging portion "a", the peak-to-peak voltage Vpp of the AC voltage is changed from Vpp−base=1,300 V to Vpp−top=1,600 V, where "Vpp−top" corresponds to a maximum value of the peak-to-peak voltage Vpp of the AC voltage (Vpp increased from Vpp−base) that is used when the predetermined area X in the image area passes through the charging portion "a". At this time, a charging bias of −400±(1,600/2) V is applied to the charging roller 2.

A length of the predetermined area X in the rotation direction of the photosensitive drum 1 including a position on the photosensitive drum 1 corresponding to the trailing edge of the recording material P may be suitably set so that the memory phenomenon can be sufficiently suppressed. It is preferred that the length of the predetermined area X be set to from about 1 mm to about 5 mm in the rotation direction of the photosensitive drum 1 across the position on the photosensitive drum 1 corresponding to the trailing edge of the recording material P. Typically, an area having a length of about 1 mm is sufficient. In Embodiment 1, the period of setting the peak-to-peak voltage Vpp of the AC voltage to Vpp−top=1,600 V is set to 30 msec, which is sufficiently long with respect to the above-mentioned area in the rotation direction of the photosensitive drum 1. In this case, it is preferred that, with the position on the photosensitive drum 1 corresponding to the trailing edge of the recording material P as a substantial center of the predetermined area X in the rotation direction of the photosensitive drum 1, an area extending from upstream to downstream with respect to the above-mentioned position be set as the predetermined area X. Further, the increased amount of Vpp−top with respect to Vpp−base of the peak-to-peak voltage Vpp of the AC voltage may suitably be set so as to sufficiently suppress the memory phenomenon, but it is preferred that the increased amount be set to from about 100 V to about 500 V.

Further, in Embodiment 1, before and after the period of setting the peak-to-peak voltage Vpp of the AC voltage to Vpp−top=1,600 V, the peak-to-peak voltage Vpp is caused to step up and down with a continuation time period of Δt=30 msec and a changed amount of ΔVpp=100 V (see FIG. 3B). That is, in Embodiment 1, the controller 50 performs control of stepwisely increasing a value of the peak-to-peak voltage Vpp of the AC voltage from a value that is used when the area other than the predetermined area X passes through the charging portion "a" to a maximum value that is used when the predetermined area X passes through the charging portion "a". Further, the controller 50 performs control of stepwisely decreasing a value of the peak-to-peak voltage Vpp of the AC voltage from the maximum value that is used when the predetermined area X passes through the charging portion "a" to the value that is used when the area other than the predetermined area X passes through the charging portion "a". In Embodiment 1, the area on the photosensitive drum 1 corresponding to a period of 150 msec, which includes the period of setting the peak-to-peak voltage Vpp of the AC voltage to Vpp−top=1, 600 V and the period of causing the peak-to-peak voltage Vpp to step up and down before and after this period, is the predetermined area X.

Next, the transfer bias is described. As the transfer bias, the DC voltage (bias in sheet) of +1,000 V is applied during a period in which the recording material P is passing through the transfer portion N, and the DC voltage (sheet-to-sheet interval bias) of +500 V is applied during a period in which the recording material P is not passing through the transfer portion N (that is, sheet-to-sheet interval).

Next, the output of the top sensor 10 is described. The output of the top sensor 10 is turned on by detection of the leading edge of the recording material P, and is turned off by detection of the trailing edge of the recording material P.

As described above, in Embodiment 1, in a case where the image area is passing through the charging portion "a" when the predetermined area X including the position on the photosensitive drum 1 corresponding to the trailing edge of the recording material P first passes through the charging portion "a", the control of changing the peak-to-peak voltage Vpp of the AC voltage is performed. Meanwhile, in a case where the non-image area on the photosensitive drum 1 is passing through the charging portion "a" when the predetermined area X including the position on the photosensitive drum 1 corresponding to the trailing edge of the preceding recording material P first passes through the charging portion "a", it is not required that the control of changing the peak-to-peak voltage Vpp of the AC voltage be performed. That is, when the conveyance interval (that is, sheet-to-sheet interval) of the recording materials P at the time of the continuous image formation is equal to or larger than one rotation of the photosensitive drum 1, it is not required that the control of changing the peak-to-peak voltage Vpp of the AC voltage be performed. This is because of the following reason. That is, in this case, the predetermined area X including the position on the photosensitive drum 1 corresponding to the trailing edge of the recording material P can pass through the charging portion "a" twice or more before the predetermined area X changes to the image area for a toner image to be transferred onto a succeeding recording material P. Therefore, the charging unevenness on the photosensitive drum 1 resulting from the transferring step is significantly alleviated, and occurrence of the memory phenomenon can be suppressed.

Figure 4:
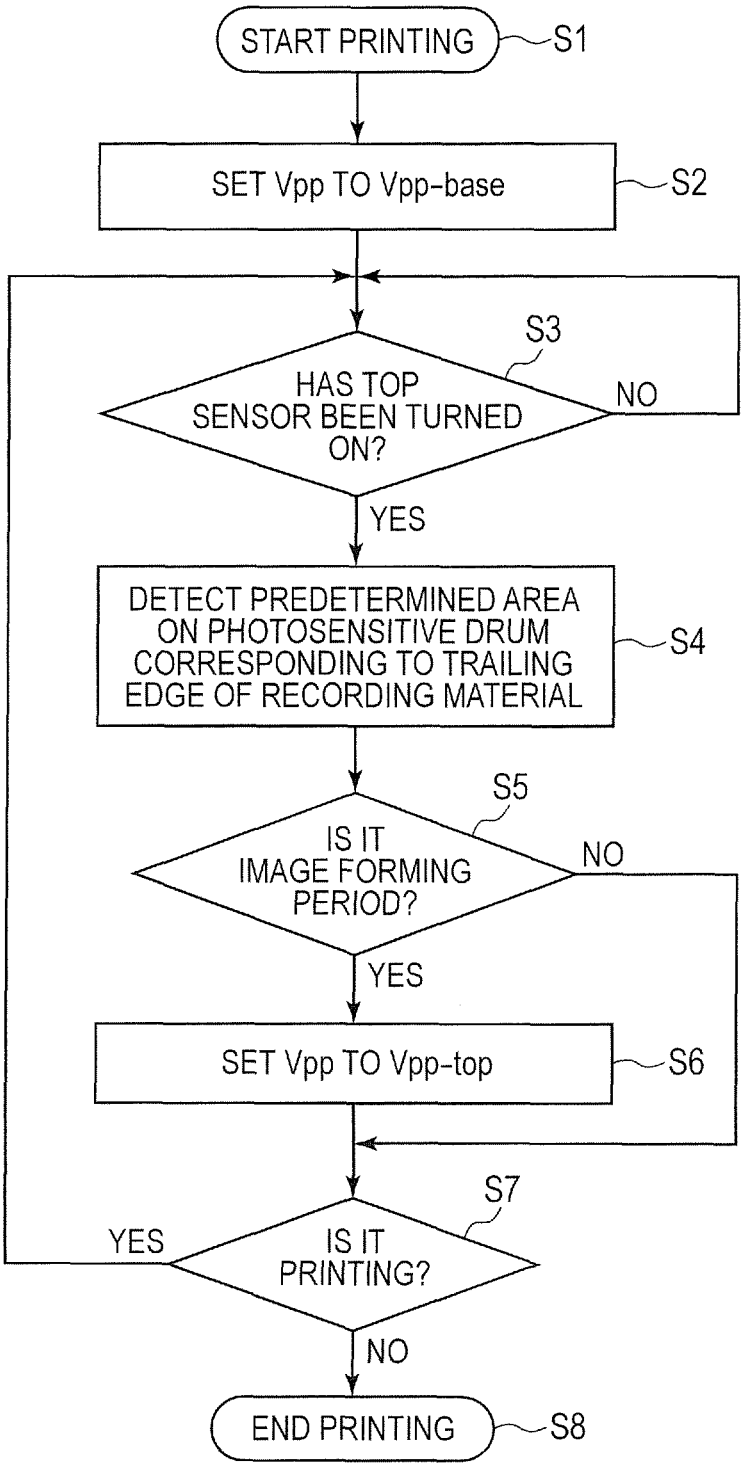
FIG. 4 is a flowchart of the charging bias control in Embodiment 1.

FIG. 4 is a flowchart for illustrating a flow of control of the charging bias in Embodiment 1. When printing is started (Step S1), the controller 50 reads a charge setting value stored in the storage device 40, and sets the peak-to-peak voltage Vpp of the AC voltage to Vpp−base (Step S2). The controller 50 monitors the output of the top sensor 10 for the arrival of the leading edge of the preceding recording material P at the position of the top sensor 10 (Step S3). When the controller 50 detects that the output is switched from OFF to ON, the controller 50 determines, through calculation based on, for example, the process speed and the size of the recording material P, the predetermined area X including the position on the photosensitive drum 1 corresponding to the trailing edge of the preceding recording material P (Step S4). Specifically, the controller 50 calculates a period A, which is required from arrival of the leading edge of the preceding recording material P at the position of the top sensor 10 to arrival of the trailing edge of the preceding recording material P at the transfer portion N, based on the process speed and the size of the recording material P. Further, the time at which the output of the sensor 10 is switched from OFF to ON with the arrival of the leading edge of the preceding recording material P at the position of the top sensor 10 is referred to as a time T1. The controller 50 specifies a surface of the photosensitive drum 1 which is at the transfer portion N when the trailing edge of the preceding recording material P arrives at the transfer portion N as the position on the photosensitive drum 1 corresponding to the trailing edge of the preceding recording material P based on the time T1 and the period A, and determines the predetermined area X based on the specified position. Further, the controller 50 determines whether or not the image area for the toner image to be transferred to the succeeding recording material P is passing through the charging portion "a" when the predetermined area X first passes through the charging portion "a" (Step S5). When it is determined in Step S5 that the image area is passing, the predetermined area X may be an area on which a toner image is formed only by passage through the charging portion "a" once, and hence the controller 50 executes the above-mentioned control of changing the peak-to-peak voltage Vpp of the AC voltage (Step S6). That is, the controller 50 reads the charge setting value stored in the storage device 40. Then, the controller 50 executes a step up/down sequence for the peak-to-peak voltage Vpp of the AC voltage so that the maximum value becomes Vpp−top when the predetermined area X on the photosensitive drum 1 passes through the charging portion "a". After that, the controller 50 determines whether or not printing has been ended (Step S7). When the printing continues, the controller 50 repeats operations of Step S3 to Step S7. When the printing has been completed, the controller 50 ends the control (Step S8).

In Step S4, the predetermined area X is determined using the time T1 at which the leading edge of the preceding recording material P arrives at the top sensor 10 as a reference. However, the reference is not limited thereto. For example, a time T2 at which the trailing edge of the preceding recording material P arrives at the top sensor 10 may be used as the reference. That is, a period B required from arrival of the trailing edge of the preceding recording material P at the position of the top sensor 10 to arrival of the trailing edge of the preceding recording material P at the transfer portion N is calculated. Then, the predetermined area X may be determined based on the time T2 and the period B. Further, calculation of the period A or the period B can be performed when the process speed and the size of the recording material P are specified. Therefore, the timing of calculating the period A or the period B may be before Step S3, before Step S2, or before Step S1.

Further, in Step S5, it is only required that determination be made on whether or not the predetermined area X of the surface of the photosensitive drum 1 is an area which arrives at the transfer portion N as an image area after passing through the charging portion "a" once and before arriving at the charging portion "a" next. Therefore, the timing of performing the determination of Step S5 may be before the timing at which the predetermined area X first passes through the charging portion "a" as long as the predetermined area X has been determined in Step S4.

3. Actions and Effects

According to Embodiment 1, occurrence of the memory phenomenon in the predetermined area X including the position on the photosensitive drum 1 corresponding to the trailing edge of the recording material P can be suppressed. This is because increases in peak-to-peak voltage Vpp of the AC voltage and a resulting increase in intensity of an oscillating electric field improve performance of settling a potential of the photosensitive drum 1, thereby being capable of alleviating the charging unevenness on the photosensitive drum 1.

Further, in Embodiment 1, the peak-to-peak voltage Vpp of the AC voltage is caused to step up and down. This is because, in Embodiment 1, the DC voltage and the AC voltage are generated from a common power supply. When the peak-to-peak voltage Vpp of the AC voltage is significantly changed, the common power supply also causes changes in DC voltage, with the result that the dark section potential VD is also changed. Therefore, there is a risk in that the density unevenness occurs in an image in accordance with the change in dark section potential VD. Therefore, it is preferred that the changed amount ΔVpp of the peak-to-peak voltage Vpp of the AC voltage per step be suppressed to a degree at which the density unevenness cannot be visually recognized. In Embodiment 1, the density unevenness was not visually recognized when the changed amount ΔVpp was equal to or less than 100 V.

4. Evaluation Experiment

Next, description is made of an evaluation experiment by which the effects of Embodiment 1 were checked.

<Experiment Conditions>

Environment: 23° C./50% (normal-temperature normal-humidity environment)

Recording Material: Vitality (product name, manufactured by Xerox Corporation) having LTR size and basis weight of 75 g/m$^2$ Process Speed: 220 mm/sec Conveyance Interval of Recording Materials: 20 mm Throughput: 40 ppm (40 sheets per minute)

Outer Diameter of Photosensitive Drum: 24 mm

Endurance Test for Photosensitive Drum: continuous printing of 10,000 sheets

<Experiment Method>

With a print mode set to a normal paper mode, two images each having a density of 25% were continuously printed, and presence of occurrence of the memory phenomenon in the second image due to the separation electric discharge between the trailing edge of the recording material P and the photosensitive drum 1 was checked. When the memory phenomenon occurred, evaluation of "x" (poor) was given. When the memory phenomenon did not occur, evaluation of "○" (good) was given. Further, a endurance test for the photosensitive drum 1 was conducted. Printing was performed with use of the photosensitive drum 1 after the endurance test, and presence of occurrence of an image defect caused by a charging defect resulting from abrasion of the charge transporting layer was confirmed. When the image defect caused by the charging defect occurred, evaluation of "x" (poor) was given. When the image defect did not occur, evaluation of "○" (good) was given.

Figure 5A:
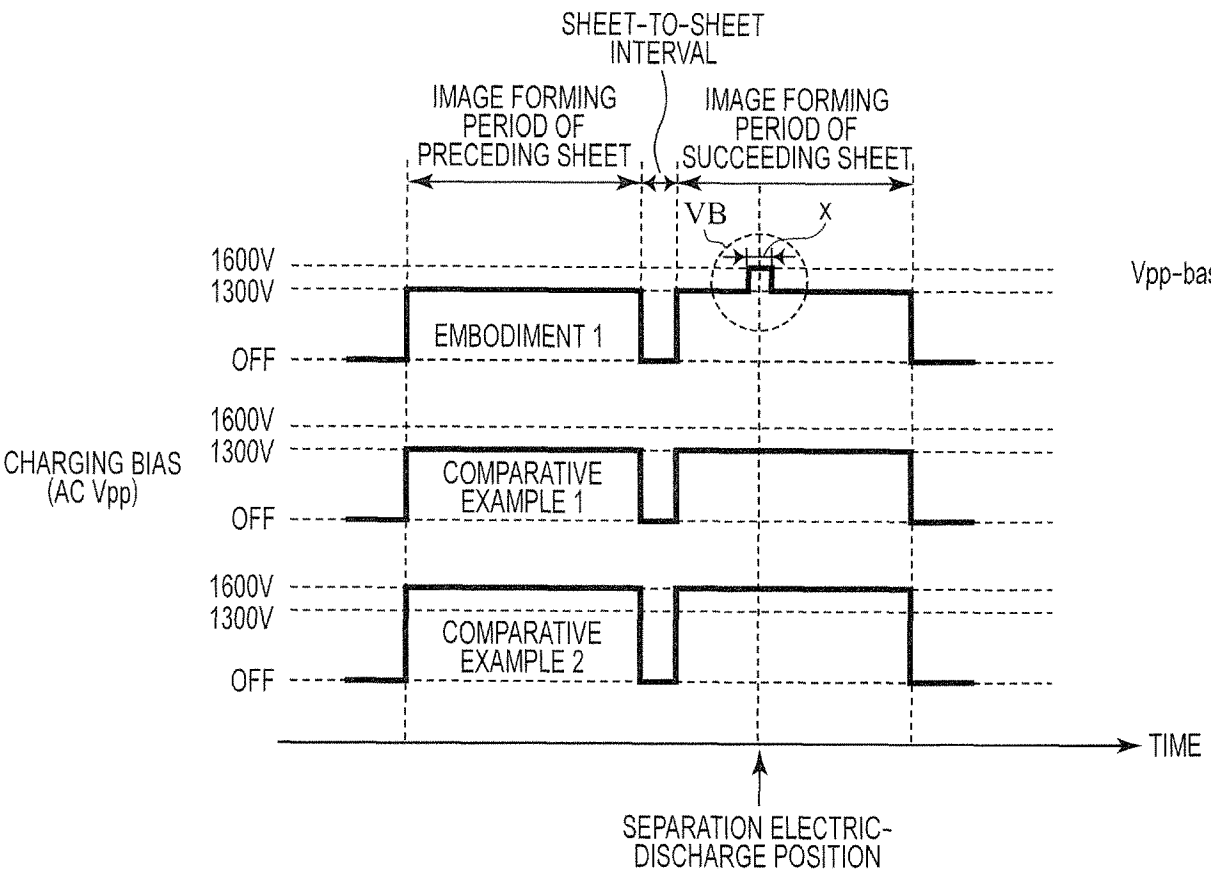
FIG. 5A is a sequence chart of charging bias control in Embodiment 1, Comparative Example 1, and Comparative Example 2.
Figure 5B:
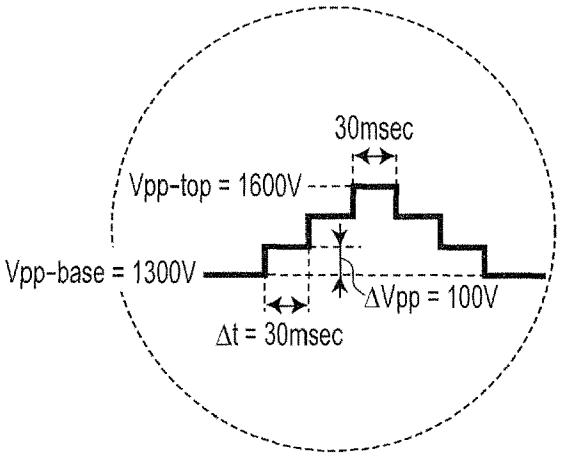
FIG. 5B is an enlarged view of the encircled portion VB in FIG. 5A.

The evaluation experiment was conducted for Embodiment 1 as well as Comparative Example 1 and Comparative Example 2 for comparison. In Comparative Example 1, the peak-to-peak voltage Vpp of the AC voltage was set to a constant value of 1,300 V (which is equal to Vpp−base in Embodiment 1). In Comparative Example 2, the peak-to-peak voltage Vpp of the AC voltage was set to a constant value of 1,600 V (which is equal to Vpp−top in Embodiment 1). FIG. 5A is a sequence chart for illustrating switching timings of the charge bias in a case where printing was continuously performed on two recording materials (here, recording sheets) P for each of Embodiment 1, Comparative Example 1, and Comparative Example 2. FIG. 5B is an enlarged view of the encircled portion VB in FIG. 5A.

<Experiment Results>

Results of the evaluation experiment are shown in Table 1.

TABLE 1

| | Peak-to-Peak Voltage Vpp of AC Voltage [V] | | Memory | Charging |
|---|---|---|---|---|
| | Vpp-top | Vpp-base | Phenomenon | Defect |
| Embodiment 1 | 1,600 | 1,300 | ○ | ○ |
| Comparative Example 1 | 1,300 | 1,300 | x | ○ |
| Comparative Example 2 | 1,600 | 1,600 | ○ | x |

In Embodiment 1, the memory phenomenon did not occur, and the charging defect did not occur also in the printing with use of the photosensitive drum 1 after the endurance test. In Embodiment 1, the peak-to-peak voltage Vpp of the AC voltage for the predetermined area X on the photosensitive drum 1 corresponding to the trailing edge of the recording material P was increased, and hence the performance of settling the potential in the predetermined area X was raised. As a result, the memory phenomenon was able to be suppressed. Further, in Embodiment 1, the electric discharge amount at the time of charging was increased as compared to that of the case in which the control of increasing the peak-to-peak voltage Vpp was not performed (Comparative Example 1). However, the period in which the peak-to-peak voltage Vpp is set large is suppressed to a minimum required period, and hence the abrasion of the photosensitive drum 1 was able to be suppressed. As a result, the charging defect of the photosensitive drum 1 after the endurance test did not occur.

Meanwhile, in Comparative Example 1, the charging defect of the photosensitive drum 1 after the endurance test did not occur, but the memory phenomenon occurred. In Comparative Example 1, the peak-to-peak voltage Vpp was evenly set small, and hence the electric discharge amount at the time of charging was smaller as compared to that of Comparative Example 2. Therefore, the abrasion of the photosensitive drum 1 was able to be suppressed. Thus, the charging defect of the photosensitive drum 1 after the endurance test did not occur. However, in Comparative Example 1, the peak-to-peak voltage Vpp of the AC voltage for the predetermined area X on the photosensitive drum 1 corresponding to the trailing edge of the recording material P was not set large. Therefore, the memory phenomenon was not able to be suppressed.

Further, in Comparative Example 2, the memory phenomenon did not occur, but the charging defect of the photosensitive drum 1 after the endurance test occurred. In Comparative Example 2, the peak-to-peak voltage Vpp of the AC voltage was evenly set large, and hence the performance of settling the potential improved entirely in the image area on the photosensitive drum 1. As a result, the memory phenomenon was able to be suppressed. However, in Comparative Example 2, the electric discharge amount at the time of charging significantly increased as compared to that of Comparative Example 1, and the abraded amount of the photosensitive drum 1 was increased. As a result, the charging defect of the photosensitive drum 1 after the endurance test occurred.

As described above, according to Embodiment 1, the charging defect resulting from abrasion of the photosensitive drum 1 can be suppressed, and occurrence of the memory phenomenon can be suppressed. Therefore, according to Embodiment 1, the image defect caused by the charging unevenness on the photosensitive drum 1 resulting from the transferring step can be suppressed.

Embodiment 2

Next, description is made of Embodiment 2 of the present invention. The basic configuration and operation of an image forming apparatus of Embodiment 2 are the same as those of the image forming apparatus of Embodiment 1. Thus, in the image forming apparatus of Embodiment 2, elements having functions or configurations that are the same as or correspond to those of the image forming apparatus of Embodiment 1 are denoted by the same reference symbols as those of Embodiment 1, and detailed description thereof is omitted.

Figure 6:
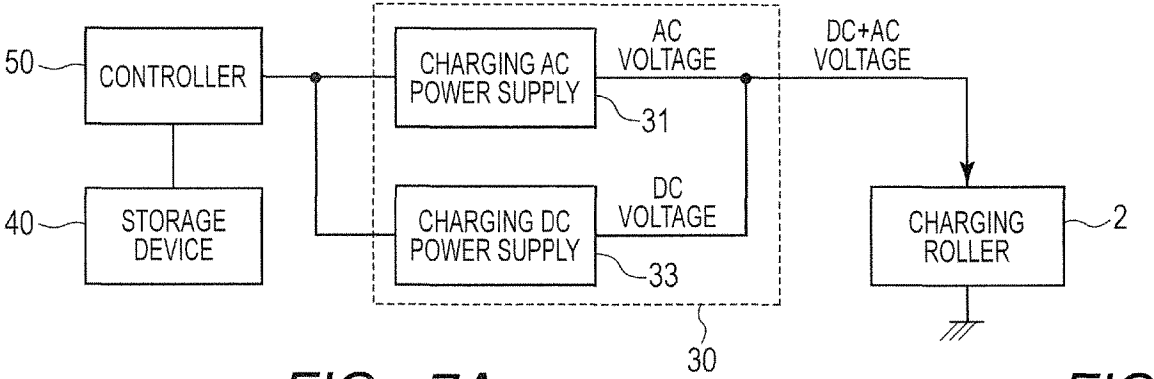
FIG. 6 is a functional block diagram for illustrating a mode of controlling a charging bias in Embodiment 2 of the present invention.

FIG. 6 is a schematic functional block diagram for illustrating a mode of controlling a charging bias in Embodiment 2. In Embodiment 2, the charging power supply 30 includes a charging AC power supply (alternate-current voltage output portion) 31 and a charging DC power supply (direct-current voltage output portion) 33. The charging power supply 30 outputs a charging bias (DC+AC voltage), which is obtained through superimposition of an AC voltage from the charging AC power supply 31 to a DC voltage from the charging DC power supply 33, and applies the charging bias to the charging roller 2. In this manner, in Embodiment 2, the DC voltage and the AC voltage are generated by separate power supplies.

Figure 7B:
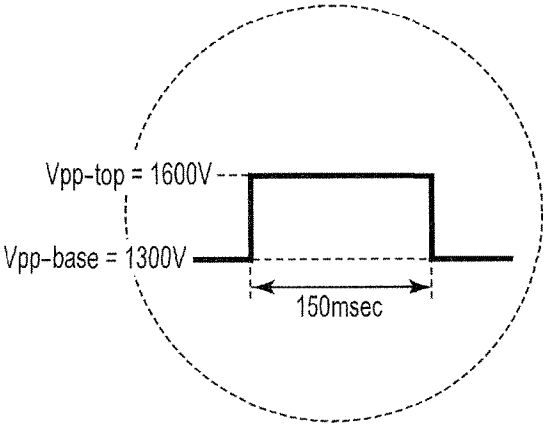
FIG. 7B is an enlarged view of the encircled portion VIIB in FIG. 7A.
Figure 7A:
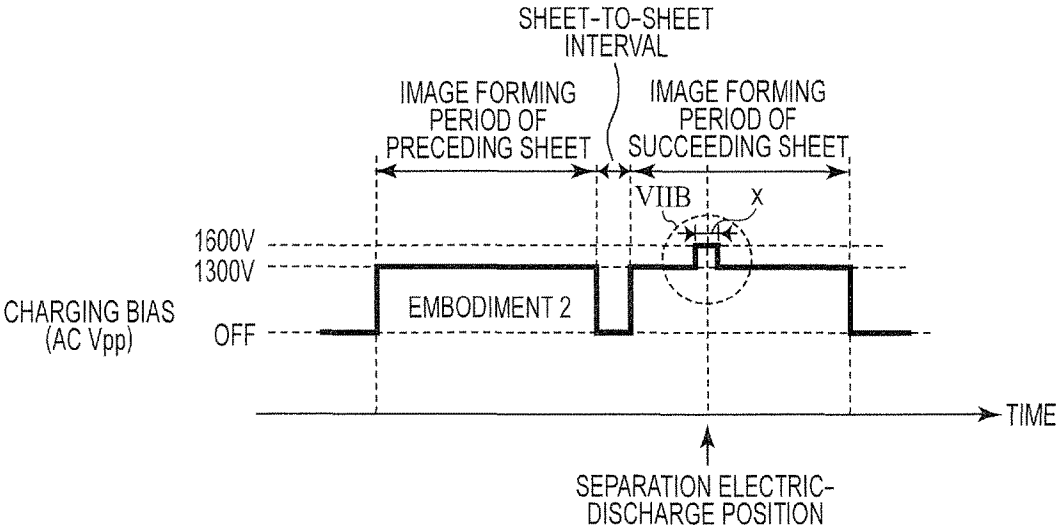
FIG. 7A is a sequence chart of charging bias control in Embodiment 2.

FIG. 7A is a sequence chart for illustrating switching timings of the charging bias in a case where printing is continuously performed on two recording materials (here, recording sheets) P in Embodiment 2. FIG. 7B is an enlarged view of the encircled portion VIIB in FIG. 7A. Similarly to FIG. 3A of Embodiment 1, FIG. 7A is a sequence chart for illustrating a case in which an image area for a toner image to be transferred onto the succeeding recording material P is passing through the charging portion "a" when the predetermined area X including the position on the photosensitive drum 1 corresponding to the trailing edge of the preceding recording material P first passes through the charging portion "a".

In Embodiment 2, unlike Embodiment 1, the peak-to-peak voltage Vpp of the AC voltage does not step up and down. The peak-to-peak voltage Vpp of the AC voltage is increased from Vpp−base to Vpp−top, and then decreased from Vpp−top to Vpp−base. This is because, in Embodiment 2, the DC voltage and the AC voltage are generated from separate power supplies, and hence, unlike Embodiment 1, it is less necessary to reduce the change in peak-to-peak voltage Vpp of the AC voltage to suppress the change in DC voltage. In Embodiment 2, an area on the photosensitive drum 1 corresponding to the period of 150 msec with the peak-to-peak voltage Vpp of the AC voltage being Vpp−top=1,600 V is the predetermined area X.

As described above, according to Embodiment 2, the effects similar to those in Embodiment 1 can be obtained, and it is not required that the peak-to-peak voltage Vpp of the AC voltage be caused to step up and down. Therefore, the sequence can be simplified as compared to that of Embodiment 1.

Embodiment 3

Next, description is made of Embodiment 3 of the present invention. The basic configuration and operation of an image forming apparatus of Embodiment 3 are the same as those of the image forming apparatus of Embodiment 1. Thus, in the image forming apparatus of Embodiment 3, elements having functions or configurations that are the same as or correspond to those of the image forming apparatus of Embodiment 1 are denoted by the same reference symbols as those of Embodiment 1, and detailed description thereof is omitted.

Figure 8:
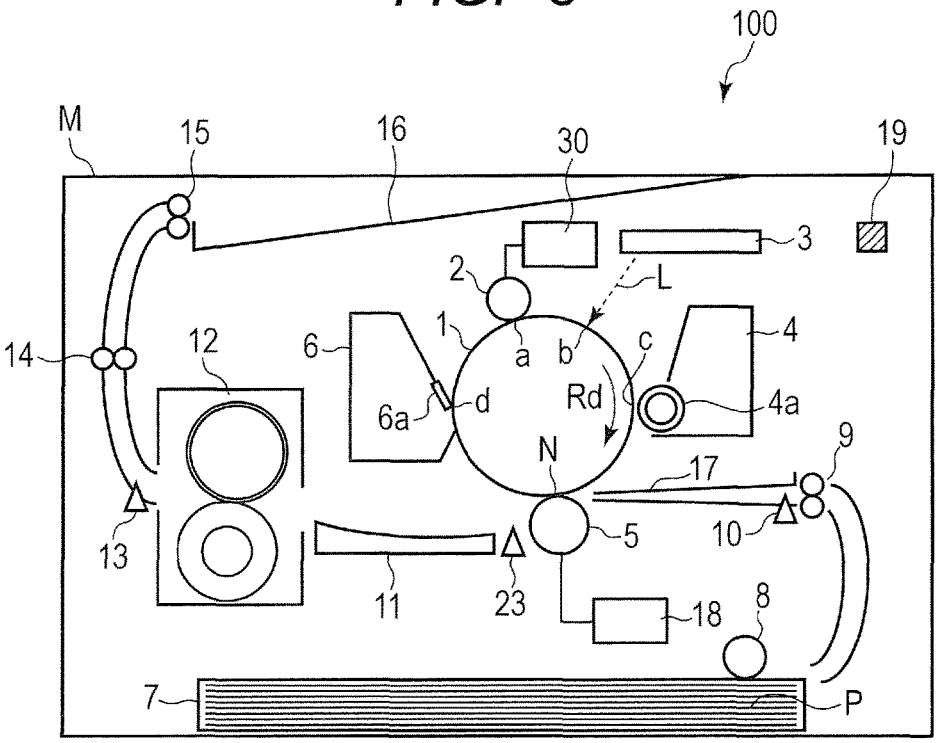
FIG. 8 is a schematic sectional view of an image forming apparatus according to Embodiment 3 of the present invention.

FIG. 8 is a schematic sectional view of an image forming apparatus 100 according to Embodiment 3. In Embodiment 3, the image forming apparatus 100 includes a temperature/humidity sensor 19 in the apparatus main body M. The temperature/humidity sensor 19 serves as an environment detection device configured to detect at least one of a temperature or a humidity at least inside and outside the apparatus main body M. In Embodiment 3, the temperature/humidity sensor 19 detects a temperature and a relative humidity inside the apparatus main body M, and inputs a signal indicating a detection result to the controller 50. In Embodiment 3, the controller 50 determines a usage environment of the image forming apparatus 100 based on the detection result of the temperature/humidity sensor 19, and changes the increased amount of the peak-to-peak voltage Vpp of the AC voltage in accordance with the determination result. That is, in Embodiment 3, based on the temperature and the relative humidity inside the apparatus main body M, the controller 50 changes the increased amount of the value of the peak-to-peak voltage Vpp of the AC voltage that is used when the predetermined area X passes through the charging portion "a" with respect to the value of the peak-to-peak voltage Vpp of the AC voltage that is used when an area other than the predetermined area X passes through the charging portion "a".

In Table 2, there is shown one example of a relationship among a determination result in the usage environment of the image forming apparatus 100, the dark section potential VD, the peak-to-peak voltage Vpp of the AC voltage, and the increased amount of the peak-to-peak voltage Vpp of the AC voltage. The "normal-temperature normal-humidity environment" represents the environment of 23° C./50%. The "low-temperature low-humidity environment" represents the environment of 15 C.°/10%. The "high-temperature high-humidity environment" represents the environment of 32.5° C./80%.

TABLE 2

| | | Peak-to-Peak Voltage Vpp of AC Voltage [V] | | Vpp Increased |
|---|---|---|---|---|
| Usage Environment | VD [V] | Vpp-top | Vpp-base | Amount |
| Low-temperature Low-humidity Environment | −450 | 1,500 | 1,300 | 200 |
| Normal-temperature | −400 | 1,600 | 1,300 | 300 |

TABLE 2-continued

| Usage Environment | VD [V] | Peak-to-Peak Voltage Vpp of AC Voltage [V] | | Vpp Increased Amount |
|---|---|---|---|---|
| | | Vpp-top | Vpp-base | |
| Normal-humidity Environment | | | | |
| High-temperature High-humidity Environment | −350 | 1,700 | 1,300 | 400 |

It is desired that the dark section potential VD of the photosensitive drum 1 be controlled so that the amount of toner to be transferred onto the photosensitive drum 1 at the time of developing is maintained constant. In Embodiment 3, a set value (controlled value) of the dark section potential VD is set to a predetermined value based on the detection result of the temperature/humidity sensor 19. The charged amount of toner changes in accordance with a temperature and a humidity of an environment in which toner is provided. In order to maintain the constant amount of toner to be transferred onto the photosensitive drum 1 at the time of developing, it is desired that an appropriate developing contrast for the charged amount of toner be set. Therefore, under the low-temperature low-humidity environment in which the charged amount of toner becomes relatively larger and a relatively large developing contrast is required, the absolute value of the dark section potential VD is set relatively larger (−450 V). Meanwhile, under the high-temperature high-humidity environment in which the charged amount of toner is relatively smaller and a relatively small developing contrast is sufficient, the absolute value of the dark section potential VD is set relatively smaller (−350 V). However, the memory phenomenon described in Embodiment 1 is more liable to occur under the high-temperature high-humidity environment in which the absolute value of the dark section potential VD is small as compared to the low-temperature low-humidity environment in which the absolute value of the dark section potential VD is large. Therefore, it is desired that the increased amount of the peak-to-peak voltage Vpp of the AC voltage be also changed to an appropriate value in accordance with the dark section potential VD.

Therefore, in Embodiment 3, Vpp−base and Vpp−top of the AC voltage for each of the low-temperature low-humidity environment, the normal-temperature normal-humidity environment, and the high-temperature high-humidity environment are set as shown in Table 2. That is, in Embodiment 3, the increased amount of the peak-to-peak voltage Vpp of the AC voltage under the normal-temperature normal-humidity environment is set larger than that under the low-temperature low-humidity environment. Further, the increased amount of the peak-to-peak voltage Vpp of the AC voltage under the high-temperature high-humidity environment is set larger than that under the normal-temperature normal-humidity environment. When the problem of the memory phenomenon is at a negligible level under the low-temperature low-humidity environment, it is not required that the control of changing the peak-to-peak voltage Vpp of the AC voltage be performed. Further, with regard to the stepping up and down of the peak-to-peak voltage Vpp of the AC voltage, for example, the same changed amount ΔVpp may be used in each environment, and the number of steps and the continuation time period Δt may be changed for each environment. Alternatively, the changed amount ΔVpp may be changed for each environment within the range of not causing the problem of change in DC voltage, and the number of steps and the continuation time period Δt may be the same in each environment. Further, similarly to Embodiment 2, when the charging power supply 30 configured to separately generate the DC voltage and the AC voltage are separately generated is used, it is not required that the stepping up and down of the peak-to-peak voltage Vpp of the AC voltage be performed in any environment.

Figure 9:
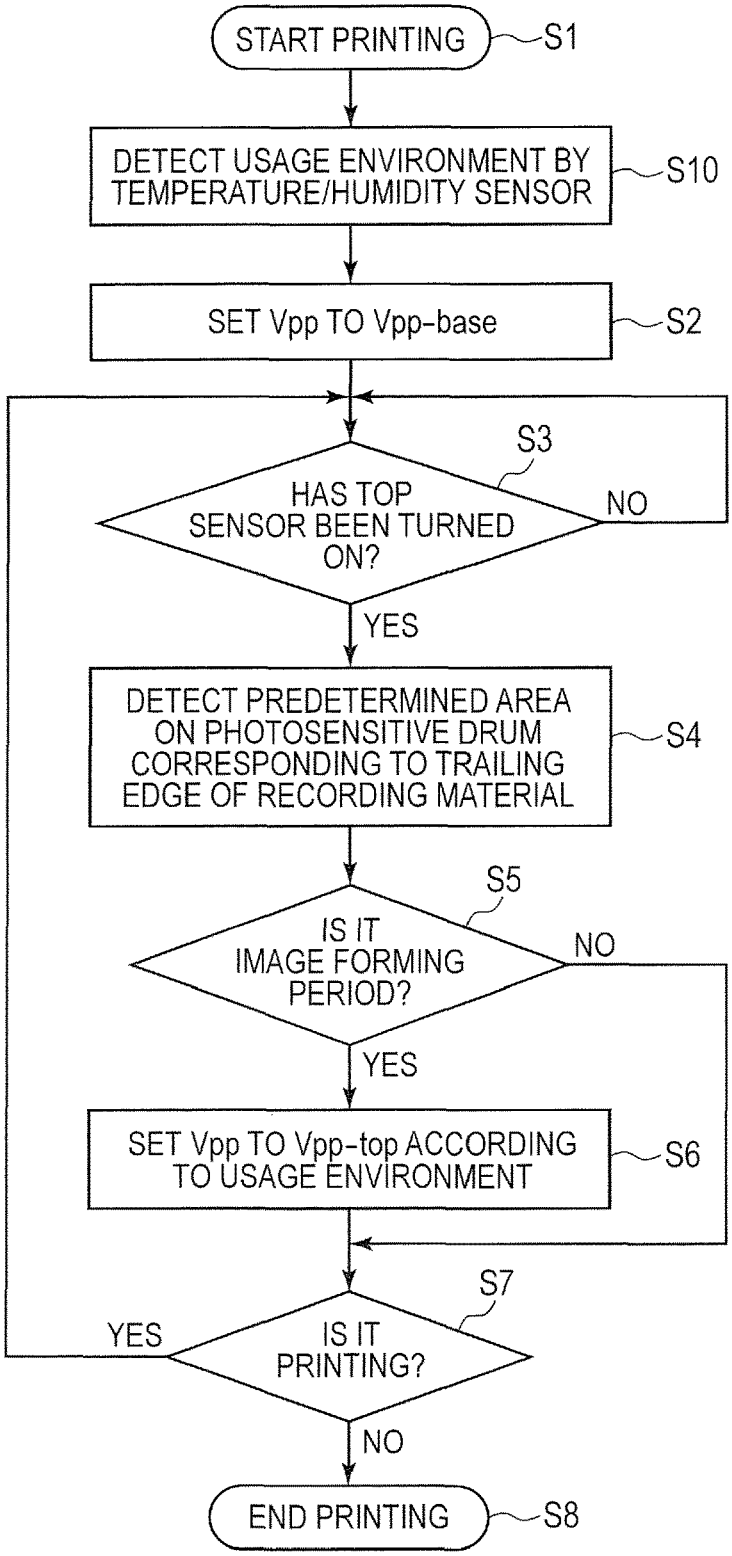
FIG. 9 is a flowchart of charging bias control in Embodiment 3.

FIG. 9 is a flowchart for illustrating a flow of control of the charging bias in Embodiment 3. The processes of Step S1 to Step S8 in the flowchart of FIG. 9 are the same as the processes of Step S1 to Step S8 in the flowchart of FIG. 4 described in Embodiment 1. In Embodiment 3, the process of Step S10 is added. That is, in Embodiment 3, after the process of Step S1, the controller 50 determines the usage environment of the image forming apparatus 100 based on the detection result of the temperature/humidity sensor 19 (Step S10). Then, in Step S6, the controller 50 reads the charge setting value stored in the storage device 40 in accordance with the usage environment of the image forming apparatus 100 determined in Step S10, and executes the control of changing the peak-to-peak voltage Vpp of the AC voltage.

As described above, according to Embodiment 3, occurrence of the memory phenomenon can be suppressed more appropriately in accordance with the usage environment of the image forming apparatus 100.

Embodiment 4

Next, description is made of Embodiment 4 of the present invention. The basic configuration and operation of an image forming apparatus of Embodiment 4 are the same as those of the image forming apparatus of Embodiment 1. Thus, in the image forming apparatus of Embodiment 4, elements having functions or configurations that are the same as or correspond to those of the image forming apparatus of Embodiment 1 are denoted by the same reference symbols as those of Embodiment 1, and detailed description thereof is omitted.

Figure 10:
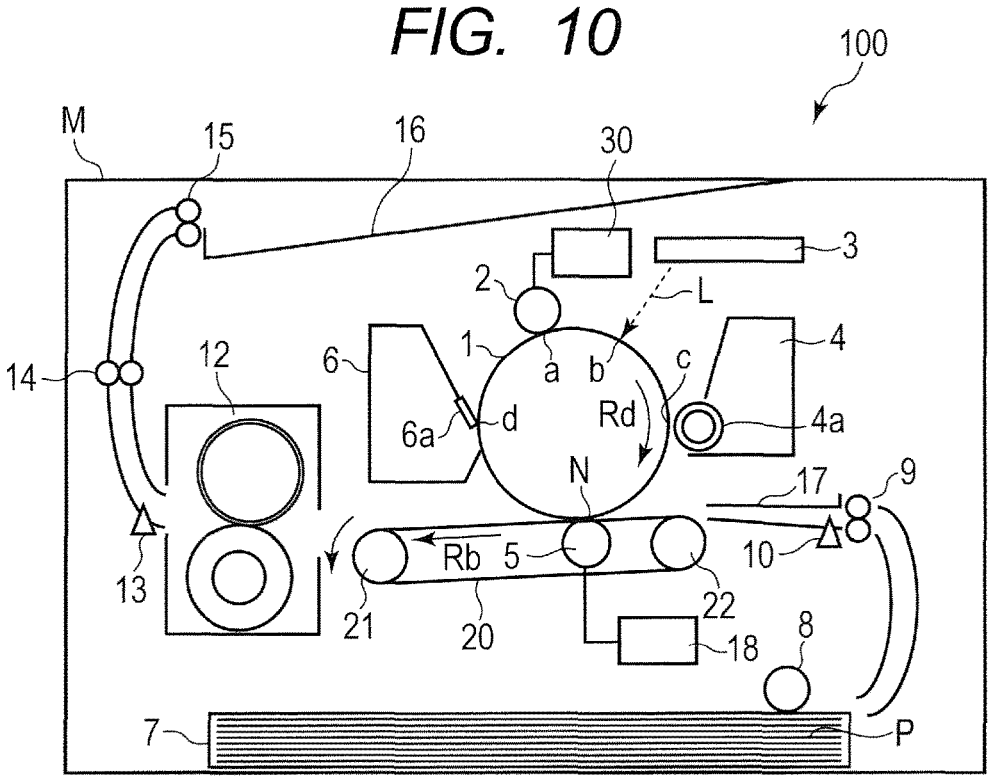
FIG. 10 is a schematic sectional view of an image forming apparatus according to Embodiment 4 of the present invention.

FIG. 10 is a schematic sectional view of an image forming apparatus 100 according to Embodiment 4. In Embodiment 4, the image forming apparatus 100 includes a transfer belt 20 serving as a recording material carrying member. The transfer belt 20 is stretched around a drive roller 21 and a driven roller 22 serving as a plurality of tension rollers (support members), and is tensioned with a predetermined tensile force. The drive roller 21 is driven to rotate so that the transfer belt 20 is rotated (moved around) in a direction indicated by an arrow Rb in FIG. 10 (counterclockwise direction).

As the transfer belt 20, there may be used a resin film having a thickness of from about 50 m to about 200 μm and a volume resistivity of from about $10^9$ Ω·cm to about $10^{16}$ Ω·cm and being made of, for example, polyvinylidene fluoride resin (PVDF), ethylene-tetrafluoroethylene copolymer resin (ETFE), polyimide, polyethylene terephthalate (PET), or polycarbonate. Alternatively, as the transfer belt 20, there may be used a belt having a configuration in which a surface of a base layer having a thickness of from about 0.5 mm to about 2 mm and being made of rubber, for example, EPDM is covered with a surface layer made of a material containing urethane rubber having fluororesin, for example, PTFE dispersed therein.

On an inner peripheral surface (back surface) side of the transfer belt 20, a transfer roller 5 which is similar to that of Embodiment 1 is arranged so as to be opposed to the photosensitive drum 1 across the transfer belt 20. The transfer roller 5 is pressed against the photosensitive drum 1 through intermediation of the transfer belt 20 to form a transfer portion (transfer nip) N, which is a contact portion between the photosensitive drum 1 and the transfer belt 20 (contact portion at the time when the recording material P is not present). In Embodiment 4, the recording material P having passed through the pre-transfer guide 17 is carried by the transfer belt 20 and conveyed to the transfer portion N. A toner image formed on the photosensitive drum 1 is transferred at the transfer portion N by the action of the transfer roller 5 onto the recording material P carried by the transfer belt 20.

The configuration having the transfer belt 20 as in Embodiment 4 is excellent in ability to separate the recording material P from the photosensitive drum 1. Further, this configuration is excellent in conveyance stability for the recording material P. Therefore, this configuration is advantageous in that image formation can easily be increased in speed.

Figure 11:
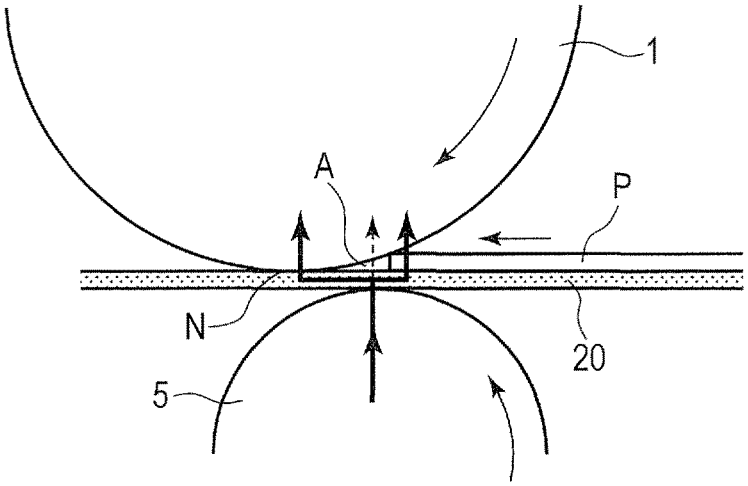
FIG. 11 is a schematic view for illustrating the vicinity of a transfer portion in Embodiment 4.

In the image forming apparatus 100 having such a configuration, partial charging unevenness on the photosensitive drum 1 resulting from the transferring step may cause a memory phenomenon involving a lateral white streak (portion having a smaller density extending along the rotation axis direction of the photosensitive drum 1) in an image to be formed later. FIG. 11 is a schematic sectional view for illustrating the vicinity of the transfer portion N at the time when the leading edge of the recording material P enters the transfer portion N. The arrow directed from the transfer roller 5 to the photosensitive drum 1 in FIG. 11 is a schematic illustration of a flow path of a transfer current. When the leading edge of the recording material P enters the transfer portion N, a gap A at which photosensitive drum 1 and the transfer belt 20 are not in contact with each other is formed, and an area in which the transfer current is less likely to flow is formed. In the area in which the transfer current is less likely to flow, the amount of positive charges that move to the photosensitive drum 1 is smaller, with the result that the absolute value of the dark section potential VD becomes larger. Consequently, the developing contrast in that area becomes smaller than that in other areas, with the result that the amount of toner that adheres at the time of developing is reduced, and the density of the image becomes lower. As described above, the partial charging unevenness on the photosensitive drum 1 resulting from the transferring step may cause the memory phenomenon involving a lateral white streak in an image to be formed later.

Therefore, in Embodiment 4, the predetermined area X on the photosensitive drum 1 that passes through the transfer portion N at a predetermined timing and may cause occurrence of the memory phenomenon is an area including a position on the photosensitive drum 1 that passes through the transfer portion N when the leading edge of the recording material P passes through the transfer portion N. In Embodiment 4, similarly to Embodiment 1, the controller 50 detects, through calculation based on ON/OFF timings of the output of the top sensor 10, the predetermined area X including the position of the photosensitive drum 1 that passes through the transfer portion N when the leading edge of the recording material P passes through the transfer portion N.

In Embodiment 4, the position on the photosensitive drum 1 that passes through the transfer portion N when the leading edge of the recording material P passes through the transfer portion N is, more specifically, a position on the photosensitive drum 1 with which the leading edge of the recording material P is brought into contact at the transfer portion N. Herein, for easy understanding, the position on the photosensitive drum 1 that passes through the transfer portion N when the leading edge of the recording material P passes through the transfer portion N is also referred to as "position on the photosensitive drum 1 corresponding to the leading edge of the recording material P".

Figure 12A:
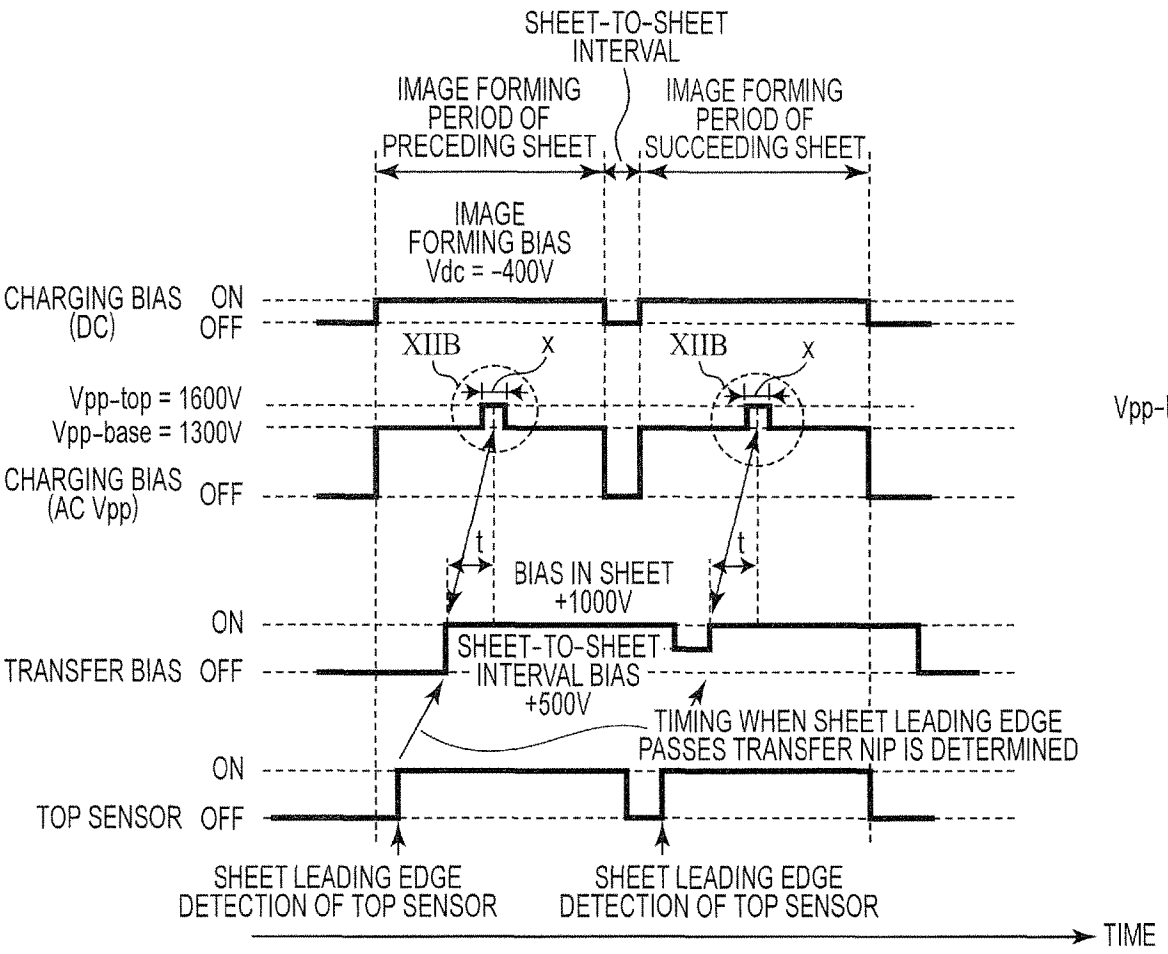
FIG. 12A is a sequence chart of charging bias control in Embodiment 4.
Figure 12B:
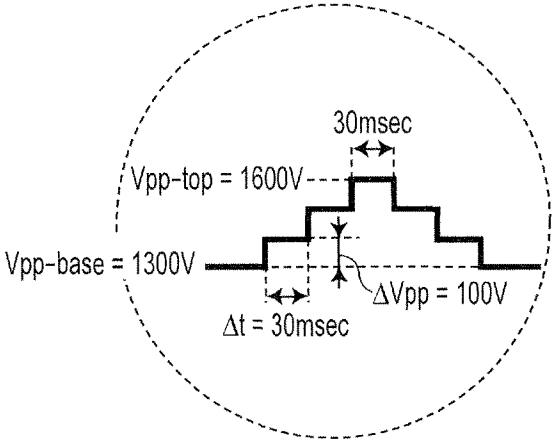
FIG. 12B is an enlarged view of the encircled portion XIIB in FIG. 12A.

FIG. 12A is a sequence chart for illustrating switching timings of the charging bias and the transfer bias and ON/OFF timings of the output of the top sensor 10 in a case where printing is continuously performed on two recording materials (which is herein recording sheets) P in Embodiment 4. FIG. 12B is an enlarged view of the encircled portion XIIB in FIG. 12A. Further, FIG. 12A is a sequence chart for illustrating a case in which an image area for a toner image to be transferred onto the recording material P is passing through the charging portion "a" when the predetermined area X including the position on the photosensitive drum 1 corresponding to the leading edge of the recording material P first passes through the charging portion "a".

The symbol "t" illustrated in FIG. 12A represents a time period from when the position on the photosensitive drum 1 corresponding to the leading edge of the recording material P has passed through the transfer portion N to when the position on the photosensitive drum 1 corresponding to the leading edge of the recording material P arrives at the charging portion "a". Further, the arrows which are illustrated so as to bridge the charts of the top sensor, the transfer bias, and the charging bias in FIG. 12A represent that timings are synchronized at both ends of each arrow. Further, although not illustrated in FIG. 12A, with regard to surface potentials of the image area on the photosensitive drum 1, before passage through the transfer portion N, the dark section potential VD is set to −400 V, and the bright section potential VL is set to −100 V.

At substantially the same timing as arrival of the image area for a toner image to be transferred onto the preceding recording material P at the charging portion "a", application of the charging bias to the charging roller 2 is started. At this time, the DC voltage is set to Vdc=−400 V, and the peak-to-peak voltage Vpp of the AC voltage is set to Vpp−base=1,300 V.

After that, in synchronization with the timing at which the predetermined area X including the position on the photosensitive drum 1 corresponding to the leading edge of the preceding recording material P passes through the charging portion "a", the peak-to-peak voltage Vpp of the AC voltage is changed from Vpp−base=1,300 V to Vpp−top=1,600 V. Further, in Embodiment 4, before and after the period of setting the peak-to-peak voltage Vpp of the AC voltage to Vpp−top=1,600 V, the peak-to-peak voltage Vpp is caused to step up and down in a similar manner as in Embodiment 1 (see FIG. 12B).

A length of the predetermined area X in the rotation direction of the photosensitive drum 1 including the position on the photosensitive drum 1 corresponding to the leading edge of the recording material P can be appropriately set so that the memory phenomenon can be sufficiently suppressed. It is preferred that the length of the predetermined area X be set to from about 1 mm to about 5 mm in the rotation direction of the photosensitive drum 1 across the position of the photosensitive drum 1 corresponding to the leading edge of the recording material P. Typically, an area having a length of about 1 mm is sufficient. In Embodiment 4, the period of setting the peak-to-peak voltage Vpp of the AC voltage to Vpp–top=1,600 V is set to 30 msec, which is sufficiently long with respect to the above-mentioned area in the rotation direction of the photosensitive drum 1. In this case, it is preferred that, with the position on the photosensitive drum 1 corresponding to the leading edge of the recording material P as a substantial center of the predetermined area X in the rotation direction of the photosensitive drum 1, an area extending from upstream to downstream with respect to the above-mentioned position be set as the predetermined area X.

At substantially the same timing as a timing at which the image area for the toner image to be transferred onto the preceding recording material P has passed through the charging portion "a", application of the charging bias is stopped. Then, at substantially the same timing as a timing at which an image area for a toner image to be transferred onto the succeeding recording material P arrives at the charging portion "a", application of the charging bias is restarted, and the charging bias is controlled by the same sequence as that described above.

In general, in a case where the predetermined area X is set to the area including the position on the photosensitive drum 1 corresponding to the leading edge of the recording material P, the image area for a toner image to be transferred onto the recording material P is passing through the charging portion "a" when the predetermined area X first passes through the charging portion "a". However, similarly to the case of Embodiment 1, in a case where the non-image area on the photosensitive drum 1 is passing through the charging portion "a" when the predetermined area X including the position on the photosensitive drum 1 corresponding to the leading edge of the recording material P first passes through the charging portion "a", it is not required that the control of changing the peak-to-peak voltage Vpp of the AC voltage be performed. Further, similarly to Embodiment 2, when the charging power supply 30 configured to separately generate the DC voltage and the AC voltage is used, it is not required that stepping up and down of the peak-to-peak voltage Vpp of the AC voltage be performed. Further, similarly to Embodiment 3, the increased amount of the peak-to-peak voltage Vpp of the AC voltage may be changed in accordance with the usage environment of the image forming apparatus 100.

The switching timings of the transfer bias and the ON/OFF timings of the top sensor 10 in the sequence chart of FIG. 12A are the same as those in the sequence chart of FIG. 3A described in Embodiment 1. Further, a flow of control of the charging bias in Embodiment 4 is the same as that of the flowchart of FIG. 4 described in Embodiment 1.

According to Embodiment 4, occurrence of the memory phenomenon in the predetermined area X including the position on the photosensitive drum 1 corresponding to the leading edge of the recording material P can be suppressed. This is because, similarly to the case of Embodiment 1, increases in peak-to-peak voltage Vpp of the AC voltage and a resulting increase in intensity of the oscillating electric field improve performance of settling a potential of the photosensitive drum 1, thereby being capable of alleviating the charging unevenness on the photosensitive drum 1.

As described above, the control in the present invention is also effective in suppressing the memory phenomenon involving a lateral white streak caused by passage of the leading edge of the recording material P through the transfer portion N.

Embodiment 5

Next, description is made of Embodiment 5 of the present invention. The basic configuration and operation of an image forming apparatus of Embodiment 5 are the same as those of the image forming apparatus of Embodiment 1. Thus, in the image forming apparatus of Embodiment 5, elements having functions or configurations that are the same as or correspond to those of the image forming apparatus of Embodiment 1 are denoted by the same reference symbols as those of Embodiment 1, and detailed description thereof is omitted.

Figure 13:
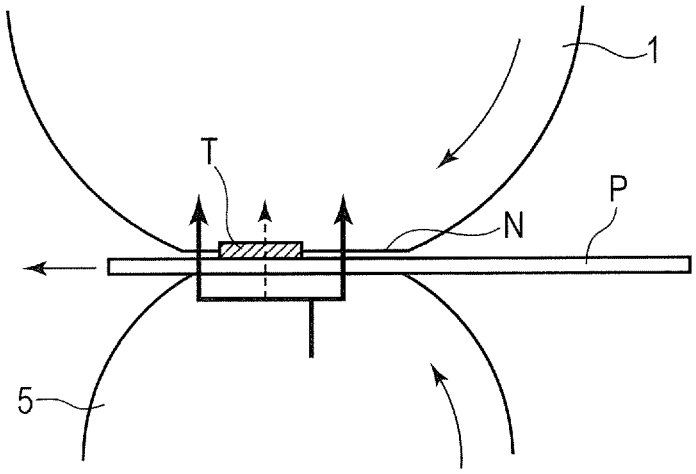
FIG. 13 is a schematic view for illustrating the vicinity of a transfer portion in Embodiment 5 of the present invention.

In some cases, the memory phenomenon is caused by the influence of the toner image that passes through the transfer portion N. FIG. 13 is a schematic sectional view for illustrating the vicinity of the transfer portion N at the time when the recording material P having toner T adhering thereto passes through the transfer portion N. The arrow directed from the transfer roller 5 to the photosensitive drum 1 in FIG. 13 is a schematic illustration of a flow path of a transfer current. In an area of the recording material P in which much toner adheres, the toner serves as a resistor, and the transfer current is less likely to flow. In the area in which the transfer current is less likely to flow, the amount of positive charges which move to the photosensitive drum 1 is smaller, with the result that the absolute value of the dark section potential VD becomes larger. Consequently, the developing contrast in that area becomes smaller than that in other areas, with the result that the amount of toner which adheres at the time of developing is reduced, and the density of the image becomes lower. As described above, the partial charging unevenness on the photosensitive drum 1 resulting from the transferring step may cause the memory phenomenon in an image, which involves formation of low-density portions corresponding to portions of the previously formed toner images with a large toner amount.

Therefore, in Embodiment 5, the predetermined area X on the photosensitive drum 1 that passes through the transfer portion N at a predetermined timing and may cause occurrence of the memory phenomenon is the following area. That is, the predetermined area X is an area including a position on the photosensitive drum 1 that passes through the transfer portion N when a toner image satisfying a predetermined condition based on image information passes through the transfer portion N. In Embodiment 5, the controller 50 has a function as a determining unit configured to determine, based on image information related to each image area, whether or not an image formed in the image area is an image in which the memory phenomenon is liable to occur. When the controller 50 determines that the image is the image in which the memory phenomenon is liable to occur, the controller 50 executes control of changing the peak-to-peak voltage Vpp of the AC voltage in accordance with the determination result.

In Embodiment 5, the controller 50 calculates, based on the image information, a coverage rate of a toner image on the recording material P as an index value correlating with a toner amount of the toner image on the recording material P or the toner image on the photosensitive drum 1 which arrives at the transfer portion N. When the calculated coverage rate is more than a predetermined threshold value, the controller 50 determines that the memory phenomenon is liable to occur. That is, in Embodiment 5, the predetermined area X in which the memory phenomenon is liable to occur is set to an area including a position on the photosensitive drum 1 that passes through the transfer portion N when the toner image in which the index value correlating with the toner amount is more than the predetermined threshold value passes through the transfer portion N, and in particular the coverage rate is used as the index value.

The coverage rate of the toner image on the recording material P can be calculated by counting the number of pixels in image data to which toner is caused to adhere for each page (for each image area), and using a ratio (area ratio) of the total number of counted pixels to which the toner is caused to adhere and the total number of pixels in each page. For example, in a case of a solid image in which the entire surface is printed with a maximum density, the coverage rate is 100%. The threshold value of the coverage rate for the determination of whether or not the image is liable to cause the memory phenomenon can be set through an experiment conducted in advance. In Embodiment 5, the threshold value is set to 80%. In particular, in Embodiment 5, an image area of each page is divided into 20 areas in the conveyance direction of the recording material P, and the above-mentioned determination is performed for each divided area. Then, the peak-to-peak voltage Vpp of the AC voltage is increased in accordance with the determination result. The number of divided areas can be suitably set so that the memory phenomenon can be sufficiently suppressed.

In Embodiment 5, the position on the photosensitive drum 1 that passes through the transfer portion N when the toner image in which the coverage rate is more than the threshold value passes through the transfer portion N is, more specifically, a position on the photosensitive drum 1 which is brought into contact with the divided area of which the coverage rate of the toner image on the recording material P exceeds the threshold value. Herein, for easy understanding, this position is also referred to as "position on the photosensitive drum 1 corresponding to the divided area of which the coverage rate is more than the threshold value".

A length of the predetermined area X in the rotation direction of the photosensitive drum 1 including the position on the photosensitive drum 1 corresponding to the divided area of which the coverage rate is more than the threshold value can be suitably set so that the memory phenomenon can be sufficiently suppressed. Typically, the predetermined area X may be an area having a length that is substantially equal to a length of the divided area in the conveyance direction of the recording material P, or may be an area which is longer than the length of the divided area by from about 1 mm to about 5 mm on each of upstream and downstream in the rotation direction of the photosensitive drum 1 over the range of the length of the divided area. In Embodiment 5, similarly to Embodiment 1, the peak-to-peak voltage Vpp of the AC voltage is set to Vpp−base=1,300 V and Vpp−top=1,600 V. The period of setting the peak-to-peak voltage Vpp of the AC voltage to Vpp−top=1,600 V is set substantially equal to the length of the divided area in the conveyance direction of the recording material P. Further, in Embodiment 5, before and after the period of setting the peak-to-peak voltage Vpp of the AC voltage to Vpp−top=1,600 V, the peak-to-peak voltage Vpp is caused to step up and down similarly to Embodiment 1.

Also in Embodiment 5, similarly to the case of Embodiment 1, in a case where the non-image area on the photosensitive drum 1 is passing through the charging portion "a" when the predetermined area X first passes through the charging portion "a", it is not required that the control of changing the peak-to-peak voltage Vpp of the AC voltage be performed. Further, similarly to Embodiment 2, when the charging power supply 30 configured to separately generate the DC voltage and the AC voltage is used, it is not required that stepping up and down of the peak-to-peak voltage Vpp of the AC voltage be performed. Further, similarly to Embodiment 3, the increased amount of the peak-to-peak voltage Vpp of the AC voltage may be changed in accordance with the usage environment of the image forming apparatus 100.

Figure 14:
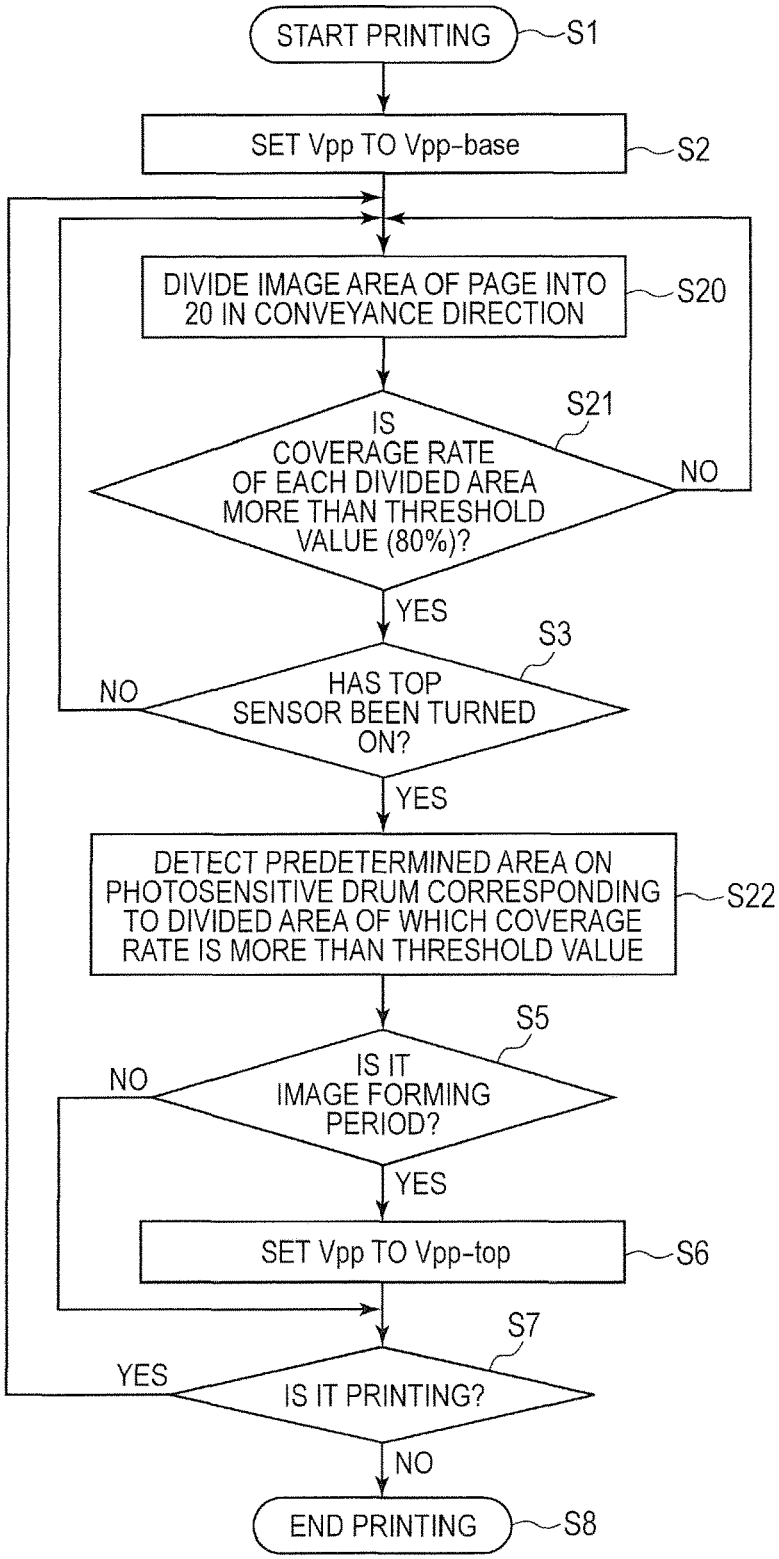
FIG. 14 is a flowchart of charging bias control in Embodiment 5.

FIG. 14 is a flowchart for illustrating a flow of charging control in Embodiment 5. Processes of Step S1 to Step S3 and Step S5 to Step S8 in the flowchart of FIG. 14 are the same as the processes of Step S1 to Step S3 and Step S5 to Step S8 in the flowchart of FIG. 4 described in Embodiment 1. In Embodiment 5, processes of Step S20 and Step S21 are added, and a process of Step S22 is performed in place of the process of Step S4 in the flowchart of FIG. 4. That is, in Embodiment 5, after the process of Step S2, with regard to a toner image to pass through the transfer portion N next, the controller 50 divides the image area into 20 areas in the conveyance direction of the recording material P, and calculates a coverage rate of a toner image on the recording material P or on the surface of the photosensitive drum 1 for each divided area (Step S20). The controller 50 determines whether or not the coverage rate of each divided area exceeds the threshold value (80%) (Step S21). The divided area of which the coverage rate is more than the threshold value is an area of the photosensitive drum 1 that arrives at the transfer portion N while carrying toner that is larger in amount than the predetermined amount. When the divided area of which the coverage rate is more than the threshold value is present, the process proceeds to Step S3. When the divided area of which the coverage rate is more than the threshold value is not present, the process proceeds to Step S7. Then, when the controller 50 detects in Step S3 that the output of the top sensor 10 is turned on, the controller 50 determines, through calculation based on, for example, the process speed, the predetermined area X including the divided area of which the coverage rate is more than the threshold value (Step S22). Then, the controller 50 determines whether or not the predetermined area X of the surface of the photosensitive drum 1 is an area that arrives at the transfer portion N as an image area after having passed through the charging portion "a" once and before arriving at the charging portion "a" next (Step S5).

The index correlating with the toner amount of the toner image on the recording material P or the toner image on the photosensitive drum 1 that arrives at the transfer portion N is not limited to the coverage rate. In Step S21, it is only required that determination of whether or not the amount of toner carried on the photosensitive drum 1 is larger than the predetermined amount can be performed. Thus, for example, a value obtained by counting, for each divided area, signals for causing the exposure device 3 to emit laser light L in accordance with image information may be used as the index. This is because more toner adheres to the photosensitive drum 1 as a period of emitting the laser light L becomes longer, and hence the value obtained by counting the signals corresponds to the amount of toner that adheres to the photosensitive drum 1. In this case, in Step S21, the controller 50 counts the signals for each divided area, and determines whether or not the counted value exceeds a threshold value set in advance.

According to Embodiment 5, occurrence of the memory phenomenon in the predetermined area X including the position on the photosensitive drum 1 corresponding to the divided area of which the coverage rate is more than the threshold value can be suppressed. This is because, similarly to the case of Embodiment 1, increases in peak-to-peak voltage Vpp of the AC voltage and a resulting increase in intensity of the oscillating electric field improve performance of settling a potential of the photosensitive drum 1, thereby being capable of alleviating the charging unevenness on the photosensitive drum 1.

As described above, the control in the present invention is also effective in suppressing the memory phenomenon caused by the influence of the toner image that passes through the transfer portion N.

Other Embodiments

The present invention is described above by way of specific embodiments. However, the present invention is not limited to the embodiments described above.

In the above-mentioned embodiments, the image forming apparatus is a monochromatic image forming apparatus including only one image forming portion. However, the present invention is also applicable to an image forming apparatus including a plurality of image forming portions, for example, a color image forming apparatus. For example, as the image forming apparatus of a direct-transfer type including the transfer belt 20 as illustrated in FIG. 10, there has been well known an image forming apparatus of a tandem type in which a plurality of (for example, four) image forming portions are arranged along the moving direction of the transfer belt 20. Each image forming portion includes, for example, the photosensitive drum 1, the charging roller 2, the exposure device 3, the developing device 4, the transfer roller 5, and the cleaning device 6 that are the same as those of FIG. 10. In such an image forming apparatus, toner images of respective colors, such as yellow, magenta, cyan, and black formed on the photosensitive drums 1 of the plurality of (for example, four) image forming portions are sequentially transferred to and superimposed on the recording material P carried by the transfer belt 20. Also in such an image forming apparatus, the control of the charging bias similar to those in the above-mentioned embodiments can be performed in each image forming portion. When the control of Embodiment 5 is applied, the predetermined area X on the photosensitive drum 1 of one image forming portion may be an area including the position on the photosensitive drum 1 that passes through the transfer portion N when a toner image that is formed in another image forming portion and satisfies the predetermined condition passes through the transfer portion N of the one image forming portion.

Figure 15:
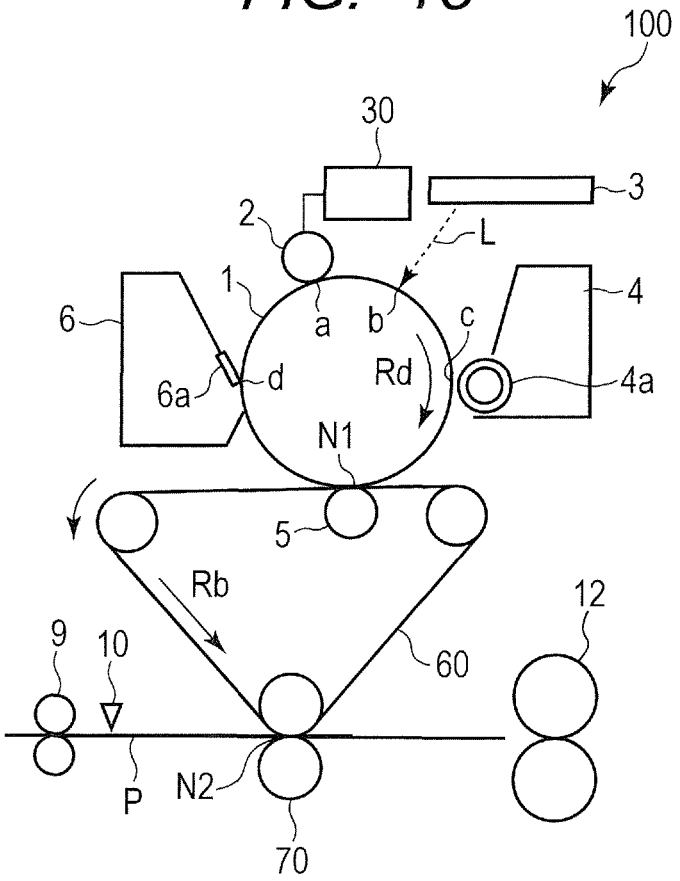
FIG. 15 is a schematic sectional view for illustrating a main portion of an image forming apparatus of an intermediate transfer type.

Further, Embodiment 5 is also applicable to an image forming apparatus of an intermediate transfer type. FIG. 15 is a schematic sectional view for illustrating a main portion of the image forming apparatus of the intermediate transfer type. Elements having functions or configurations that are the same as or correspond to those of the image forming apparatus of the above-mentioned embodiments are denoted by the same reference symbols. The image forming apparatus of the intermediate transfer type includes, in place of the recording material carrying member in the image forming apparatus of the direct transfer type illustrated in FIG. 10, an intermediate transfer belt 60, which serves as an intermediate transfer member and is formed of, for example, an endless belt. The transfer belt 60 is stretched around a plurality of tension rollers and tensioned with a predetermined tensile force. On an inner peripheral surface side of the intermediate transfer belt 60, for example, a primary transfer roller 5 serving as a primary transfer member is arranged so as to be opposed to the photosensitive drum 1 across the intermediate transfer belt 60, thereby forming a primary transfer portion N1 being a contact portion between the photosensitive drum 1 and the intermediate transfer belt 60. On an outer peripheral surface side of the intermediate transfer belt 60, for example, a secondary transfer roller 70 serving as a secondary transfer member is arranged so as to be opposed to one of the plurality of tension rollers, thereby forming a secondary transfer portion N2 being a contact portion between the intermediate transfer belt 60 and the secondary transfer roller 70. In the image forming apparatus of the intermediate transfer type, the toner image formed on the photosensitive drum 1 is primarily transferred at the primary transfer portion N1 onto the intermediate transfer belt 60 by an action of the primary transfer roller 5 to which a voltage is applied. The toner image having been primarily transferred onto the intermediate transfer belt 60 is secondarily transferred at the secondary transfer portion N2 onto the recording material P, for example, paper, by the secondary transfer roller 70 to which a voltage is applied. Also in such an image forming apparatus, in a similar manner as that described in Embodiment 5, the memory phenomenon may occur due to the influence of the toner image that passes through the primary transfer portion N1. Thus, also in such an image forming apparatus, for example, the control of the charging bias similar to that of Embodiment 5 can be performed.

In FIG. 15, only one image forming portion is illustrated for easy understanding. However, similarly to the case of the image forming apparatus of the direct transfer type described above, as the image forming apparatus of the intermediate transfer type including the intermediate transfer belt 60, there has been well known an image forming apparatus of a tandem type in which a plurality of (for example, four) image forming portions are arranged along the moving direction of the intermediate transfer belt 60. In such an image forming apparatus, toner images of respective colors, such as yellow, magenta, cyan, and black formed on the photosensitive drums 1 of the plurality of (for example, four) image forming portions are sequentially transferred to and superimposed on the intermediate transfer belt 60. Similarly to the case of the image forming apparatus of the direct transfer type described above, when the control of Embodiment 5 is applied, the predetermined area X on the photosensitive drum 1 of one image forming portion can be detected based on a toner image that is formed in another image forming portion and satisfies the predetermined condition.

Further, in Embodiment 3, as an example of a state of the image forming apparatus, the increased amount of the peak-to-peak voltage Vpp of the AC voltage is changed in accordance with the usage environment of the image forming apparatus. In particular, in Embodiment 3, the increased amount of the peak-to-peak voltage Vpp of the AC voltage is changed in accordance with detection results of temperature and humidity by the temperature/humidity sensor. However, an appropriate value of the increased amount of the peak-to-peak voltage Vpp of the AC voltage may have sufficient correlation with at least one of a temperature or a humidity. Thus, the increased amount of the peak-to-peak voltage Vpp of the AC voltage can be changed based on at least one of a temperature or a humidity of the environment. Typically, the increased amount is set so that, as compared to the increased amount in the case where a temperature is at a first temperature, the increased amount in the case where a temperature is at a second temperature higher than the first temperature is larger. Further, the increased amount is set so that, as compared to the increased amount in the case where the humidity is at a first humidity, the increased amount in the case where the humidity is at a second humidity higher than the first humidity is larger.

Further, the state of the image forming apparatus is not limited to the usage environment of the image forming apparatus, and may be a lifetime condition (used amount condition) of components of the image forming apparatus. For example, the increased amount of the peak-to-peak voltage Vpp of the AC voltage can be changed in accordance with the use condition of the photosensitive drum. In this case, as information correlated with the used amount of the photosensitive drum 1 from the start of use, the controller 50 can successively integrate the number of rotation, the rotation time, the charging time (time period for which the charging is performed), or the number of times of image formation with regard to the photosensitive drum 1, and store the same in the storage device 40 (for example, see FIG. 2). Then, based on information indicating a relationship between the increased amount of the peak-to-peak voltage Vpp of the AC voltage calculated in advance and stored in the storage device 40 and the used amount of the photosensitive drum 1, the controller 50 can determine the increased amount of the peak-to-peak voltage Vpp of the AC voltage in accordance with a current used amount of the photosensitive drum 1. For example, in a configuration in which an absolute value of the dark section potential decreases as the used amount of the photosensitive drum 1 increases, the increased amount is set so that, as compared to the increased amount in the case where the used amount of the photosensitive drum 1 is at a first used amount, the increased amount in the case where the used amount is at a second used amount larger than the first used amount is larger.

According to the present invention, the image defect caused by the charging unevenness on the photosensitive member resulting from the transferring step can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2017-012504, filed Jan. 26, 2017, and 2018-006621, filed Jan. 18, 2018, which are hereby incorporated by reference herein in their entirety.

What is claimed is:

1. An image forming apparatus, comprising:

a photosensitive member, which is rotatable;

a charging member configured to charge the photosensitive member at a charging portion;

an applying device configured to apply a charging voltage to the charging member, the charging voltage being obtained by superimposing an alternate-current voltage on a direct-current voltage;

an exposure device configured to expose the charged photosensitive member with light to form an electrostatic image on an image area on the photosensitive member;

a developing device configured to supply toner to the electrostatic image on the photosensitive member to form a toner image;

a transfer member to which a voltage is applied to transfer the toner image on the photosensitive member to a recording material at a transfer portion; and a controller configured to control the charging voltage, wherein a predetermined area is an area of the photosensitive member including a position on the photosensitive member that passes through the transfer portion when a trailing edge of the recording material in a conveyance direction of the recording material passes through the transfer portion, and wherein the controller controls a value of a peak-to-peak voltage of the alternate-current voltage of the charging voltage that is applied to the charging member when the predetermined area passes through the charging portion to be larger than a value of a peak-to-peak voltage of the alternate-current voltage when an area that becomes the image area other than the predetermined area passes through the charging portion.

2. An image forming apparatus according to claim 1, wherein the transfer member is arranged so as to be directly opposed to the photosensitive member when the recording material is not present at the transfer portion.

3. An image forming apparatus according to claim 1, further comprising a recording material carrying member configured to carry and convey the recording material, wherein the transfer member is arranged so as to be opposed to the photosensitive member across the recording material carrying member.

4. An image forming apparatus according to claim 1, wherein the controller performs control of stepwisely increasing a value of a peak-to-peak voltage of the alternate-current voltage from a value when an area other than the predetermined area passes through the charging portion to a maximum value when the predetermined area passes through the charging portion, and stepwisely decreasing the value of the peak-to-peak voltage of the alternate-current voltage from the maximum value when the predetermined area passes through the charging portion to the value when an area other than the predetermined area passes through the charging portion.

5. An image forming apparatus according to claim 1, wherein the controller changes an increased amount of the value of the peak-to-peak voltage of the alternate-current voltage when the predetermined area passes through the charging portion with respect to the value of the peak-to-peak voltage of the alternate-current voltage when an area other than the predetermined area passes through the charging portion.

6. An image forming apparatus according to claim 5, wherein the controller changes the increased amount based on at least one of a temperature and a humidity of an environment.

7. An image forming apparatus according to claim 5, wherein the controller changes the increased amount based on information correlated with a used amount of the photosensitive member.

8. An image forming apparatus according to claim 1, wherein the predetermined area is an area that first arrives at the charging portion after passing through the transfer portion.

9. An image forming apparatus, comprising:

a photosensitive member, which is rotatable;

a charging member configured to charge the photosensitive member at a charging portion;

an applying device configured to apply a charging voltage to the charging member, the charging voltage being obtained by superimposing an alternate-current voltage on a direct-current voltage;

an exposure device configured to expose the charged photosensitive member with light to form an electrostatic image on an image area on the photosensitive member;

a developing device configured to supply toner to the electrostatic image on the photosensitive member to form a toner image;

a transfer member to which a voltage is applied to transfer the toner image on the photosensitive member to a recording material at a transfer portion; and a controller configured to perform control of setting a value of a peak-to-peak voltage of the alternate-current voltage of the charging voltage that is applied to the charging member when a predetermined area passes through the charging portion to be larger than a value of a peak-to-peak voltage of the alternate-current voltage when an area that becomes the image area other than the predetermined area passes through the charging portion, the predetermined area being an area of the photosensitive member including a position on the photosensitive member that passes through the transfer portion when a leading edge of the recording material in a conveyance direction of the recording material passes through the transfer portion.

10. An image forming apparatus according to claim 9, wherein the transfer member is arranged so as to be directly opposed to the photosensitive member when the recording material is not present at the transfer portion.

11. An image forming apparatus according to claim 9, further comprising a recording material carrying member configured to carry and convey the recording material, wherein the transfer member is arranged so as to be opposed to the photosensitive member across the recording material carrying member.

12. An image forming apparatus according to claim 9, wherein the controller performs control of stepwisely increasing a value of a peak-to-peak voltage of the alternate-current voltage from a value when an area other than the predetermined area passes through the charging portion to a maximum value when the predetermined area passes through the charging portion, and stepwisely decreasing the value of the peak-to-peak voltage of the alternate-current voltage from the maximum value when the predetermined area passes through the charging portion to the value when an area other than the predetermined area passes through the charging portion.

13. An image forming apparatus according to claim 9, wherein the controller changes an increased amount of the value of the peak-to-peak voltage of the alternate-current voltage when the predetermined area passes through the charging portion with respect to the value of the peak-to-peak voltage of the alternate-current voltage when an area other than the predetermined area passes through the charging portion.

14. An image forming apparatus according to claim 13, wherein the controller changes the increased amount based on at least one of a temperature and a humidity of an environment.

15. An image forming apparatus according to claim 13, wherein the controller changes the increased amount based on information correlated with a used amount of the photosensitive member.

16. An image forming apparatus according to claim 9, wherein the predetermined area is an area that first arrives at the charging portion after passing through the transfer portion.

* * * * *